US009823048B2

(12) United States Patent
Tubb

(10) Patent No.: US 9,823,048 B2
(45) Date of Patent: Nov. 21, 2017

(54) BALLISTIC EFFECT COMPENSATING RETICLE AND AIM COMPENSATION METHOD

(71) Applicant: G. David Tubb, Canadian, TX (US)

(72) Inventor: G. David Tubb, Canadian, TX (US)

( * ) Notice: Subject to any disclaimer, the term of this patent is extended or adjusted under 35 U.S.C. 154(b) by 0 days.

(21) Appl. No.: 15/421,061

(22) Filed: Jan. 31, 2017

(65) Prior Publication Data

US 2017/0234652 A1 Aug. 17, 2017

Related U.S. Application Data

(62) Division of application No. 14/216,674, filed on Mar. 17, 2014, now Pat. No. 9,581,415, which is a division of application No. 13/342,197, filed on Jan. 2, 2012, now Pat. No. 8,701,330.

(60) Provisional application No. 61/437,990, filed on Jan. 31, 2011, provisional application No. 61/429,128, filed on Jan. 1, 2011.

(51) Int. Cl.
*F41G 1/38* (2006.01)
*F41G 3/08* (2006.01)

(52) U.S. Cl.
CPC ..... *F41G 3/08* (2013.01); *F41G 1/38* (2013.01)

(58) Field of Classification Search
CPC ... F41G 1/04; F41G 1/38; F41G 1/473; G02B 23/14; G02B 27/32
See application file for complete search history.

(56) References Cited

U.S. PATENT DOCUMENTS 7,937,878 B2 * 5/2011 Sammut ..... F41G 1/38 42/122
8,353,454 B2 * 1/2013 Sammut ..... F41G 1/38 235/404
2006/0260171 A1 * 11/2006 Cole ..... G02B 23/145 42/122

* cited by examiner

*Primary Examiner* — Gabriel Klein
(74) *Attorney, Agent, or Firm* — J. Andrew McKinney, Jr.; McKinney & Associates, LLC.

(57) ABSTRACT

A ballistic effect compensating reticle (e.g., 200 or 300) and aim compensation method for rifle sights or projectile weapon aiming systems includes a multiple point elevation and windage aim point field (e.g., 150 or 350) including a primary aiming mark (e.g., 158 or 358) indicating a primary aiming point adapted to be sighted-in at a first selected range and a plurality of secondary aiming points arrayed beneath the primary aiming mark. The method for compensating for a projectile's ballistic behavior while developing a field expedient firing solution permits the shooter to express the field expedient firing solution in units of distance, (e.g., yards or meters, when describing or estimating range and nominal air density ballistic characteristics), and velocity (e.g., mph or kph, for windage hold points).

7 Claims, 21 Drawing Sheets

| L-WND | | R-WND | | Aero Jump | | Left ↑ | 6mph/.25 | 12mph/.5 | 18mph/.75 | 24mph/1 | 30mph/1.25 | 36mph/1.5 | RightJ |
|---|---|---|---|---|---|---|---|---|---|---|---|---|---|
| 10X-W | MPH/ML | MPH/ML | 10X-W | YDS/SD | 2K | SL | 2K | 4K | 6K | 8K | 10K | 12K | 14K |
| 1.1 | 30.9 | 26.9 | 1.3 | 200 | 0.0 | 0.9 | 0.9 | 0.9 | 0.9 | 0.9 | 0.8 | 0.8 | 0.8 |
| 1.4 | 24.9 | 21.2 | 1.6 | 50 | 1.8 | 1.8 | 1.8 | 1.7 | 1.7 | 1.7 | 1.7 | 1.7 | 1.7 |
| 1.8 | 18.8 | 16.4 | 2.1 | 300 | 2.8 | 2.6 | 2.6 | 2.8 | 2.7 | 2.7 | 2.6 | 2.6 | 2.6 |
| 2.1 | 16.1 | 14.1 | 2.4 | 50 | 4.0 | 3.9 | 3.9 | 3.8 | 3.7 | 3.7 | 3.6 | 3.6 | 3.5 |
| 2.4 | 14.1 | 12.3 | 2.8 | 400/L | 5.3 | 5.1 | 5.0 | 4.9 | 4.9 | 4.8 | 4.7 | 4.7 | 4.6 |
| 2.8 | 12.1 | 10.5 | 3.3 | 50 | 6.5 | 6.4 | 6.3 | 6.2 | 6.1 | 6.0 | 5.9 | 5.8 | 5.7 |
| 3.2 | 10.9 | 9.5 | 3.6 | 500/L | 7.9 | 7.7 | 7.6 | 7.4 | 7.3 | 7.1 | 7.0 | 6.9 | 6.7 |
| 3.7 | 9.3 | 8.1 | 4.2 | 50 | 9.4 | 9.1 | 8.9 | 8.7 | 8.5 | 8.4 | 8.2 | 8.0 | 7.9 |
| 4.2 | 8.3 | 7.3 | 4.7 | 600/L | 10.9 | 10.6 | 10.3 | 10.1 | 9.9 | 9.7 | 9.5 | 9.3 | 9.1 |
| 4.6 | 7.5 | 6.6 | 5.2 | 50 | 12.6 | 12.1 | 11.7 | 11.5 | 11.3 | 11.0 | 10.8 | 10.6 | 10.4 |
| 5.1 | 6.8 | 6.0 | 5.8 | 700/L | 14.4 | 13.7 | 13.3 | 13.0 | 12.8 | 12.5 | 12.3 | 12.0 | 11.8 |
| 5.7 | 6.1 | 5.3 | 6.4 | 50 | 16.2 | 15.6 | 15.1 | 14.6 | 14.3 | 14.1 | 13.8 | 13.5 | 13.2 |
| 6.3 | 5.6 | 4.9 | 7.1 | 800/L | 18.1 | 17.4 | 16.7 | 16.2 | 15.8 | 15.5 | 15.2 | 14.9 | 14.6 |
| 6.7 | 5.1 | 4.5 | 7.6 | 50 | 20.2 | 19.3 | 18.5 | 18.0 | 17.4 | 17.1 | 16.7 | 16.4 | 16.1 |
| 7.3 | 4.7 | 4.2 | 8.3 | 900/L | 22.4 | 21.4 | 20.5 | 19.9 | 19.3 | 18.7 | 18.4 | 18.0 | 17.6 |
| 7.9 | 4.4 | 3.8 | 8.9 | 50 | 24.7 | 23.5 | 22.5 | 21.9 | 21.2 | 20.6 | 20.1 | 19.7 | 19.4 |
| 8.5 | 4.1 | 3.6 | 9.6 | 1000/L | 27.1 | 25.7 | 24.7 | 24.0 | 23.3 | 22.6 | 21.9 | 21.2 | 20.8 |
| 9.2 | 3.8 | 3.3 | 10.4 | 50 | 29.7 | 28.2 | 27.1 | 26.0 | 25.2 | 24.5 | 23.7 | 23.0 | 22.3 |
| 9.9 | 3.5 | 3.1 | 11.2 | 1100/L | 32.5 | 30.6 | 29.3 | 28.8 | 27.3 | 26.4 | 25.6 | 24.8 | 24.1 |

| L-WND | | R-WND | | Aero Jump | | Left ↑ | 6mph/.25 | 12mph/.5 | 18mph/.75 | 24mph/1 | 30mph/1.25 | 36mph/1.5 | RightJ |
|---|---|---|---|---|---|---|---|---|---|---|---|---|---|
| 10X-W | MPH/ML | MPH/ML | 10X-W | YDS/SD | 2K | SL | 2K | 4K | 6K | 8K | 10K | 12K | 14K |
| 9.9 | 3.5 | 3.1 | 11.2 | 1100/L | 32.5 | 30.6 | 29.3 | 28.2 | 27.2 | 26.2 | 25.4 | 24.7 | 23.9 |
| 10.5 | 3.3 | 2.9 | 11.9 | 50/5L | 35.4 | 33.3 | 31.6 | 30.3 | 29.3 | 28.3 | 27.4 | 26.6 | 25.8 |
| 11.2 | 3.1 | 2.7 | 12.7 | 200/6L | 38.5 | 36.0 | 34.2 | 32.8 | 31.7 | 30.6 | 29.5 | 28.6 | 27.8 |
| 12.0 | 2.9 | 2.5 | 13.5 | 50/7L | 41.8 | 38.9 | 36.9 | 35.5 | 34.0 | 32.7 | 31.5 | 30.6 | 29.7 |
| 12.8 | 2.7 | 2.4 | 14.5 | 300/8L | 45.3 | 42 | 40.0 | 38.0 | 36.5 | 35.0 | 33.8 | 32.5 | 31.5 |
| 13.6 | 2.5 | 2.2 | 15.3 | 50/9L | 49.0 | 45.3 | 43.1 | 40.9 | 38.9 | 37.3 | 35.8 | 34.6 | 33.4 |
| 14.5 | 2.4 | 2.1 | 16.3 | 400/10L | 52.9 | 48.7 | 46.3 | 43.7 | 41.6 | 39.8 | 38.3 | 36.9 | 35.6 |
| 15.3 | 2.2 | 2.0 | 17.2 | 50/11L | 57.0 | 52.4 | 49.6 | 46.8 | 44.5 | 42.5 | 40.8 | 39.2 | 37.8 |
| 16.3 | 2.1 | 1.9 | 18.3 | 500/12L | 61.4 | 56.2 | 52.8 | 49.9 | 47.4 | 45.0 | 43.2 | 41.5 | 40.0 |
| 16.8 | 2.0 | 1.8 | 19.0 | 50/13L | 65.9 | 60.3 | 56.7 | 53.6 | 50.6 | 48.1 | 45.9 | 43.9 | 42.1 |
| 17.8 | 1.9 | 1.7 | 19.9 | 600/14L | 70.7 | 64.5 | 60.6 | 56.9 | 53.7 | 51.0 | 48.7 | 46.5 | 44.7 |
| 18.6 | 1.9 | 1.7 | 20.8 | 50/15L | 75.7 | 68.9 | 64.6 | 60.7 | 57.2 | 54.2 | 51.5 | 49.1 | 47.1 |
| 19.3 | 1.8 | 1.6 | 21.7 | 700/16L | 81.0 | 73.5 | 68.7 | 64.6 | 60.9 | 57.6 | 54.5 | 51.8 | 49.7 |
| 20.2 | 1.7 | 1.5 | 22.6 | 50/17L | 86.4 | 78.4 | 73.3 | 68.7 | 64.6 | 60.9 | 57.7 | 54.8 | 52.3 |
| 21.1 | 1.6 | 1.5 | 23.6 | 800/18L | 92.1 | 83.4 | 77.9 | 72.9 | 68.3 | 64.4 | 60.8 | 57.8 | 55.2 |
| 21.9 | 1.6 | 1.4 | 24.6 | 50/19L | 98.0 | 88.7 | 82.7 | 77.3 | 72.5 | 68.1 | 64.2 | 60.7 | 57.8 |
| 22.8 | 1.5 | 1.4 | 25.6 | 900/20L | 104.2 | 94.0 | 87.7 | 82.0 | 76.9 | 72.1 | 67.9 | 64.0 | 60.8 |
| 23.5 | 1.5 | 1.3 | 26.3 | 50/21L | 110.5 | 99.7 | 92.7 | 86.7 | 81.1 | 76.0 | 71.5 | 67.3 | 64.0 |
| 24.3 | 1.4 | 1.3 | 27.3 | 200/22L | 117.1 | 105.3 | 98.0 | 91.7 | 85.5 | 80.1 | 75.3 | 70.8 | 67.3 |

270

FIG. 6

Step One

The fence is bigger than the coyote so range the fence posts.

MIL the fence ... = approximately 1-3/4 MIL

Fence post = 4 ft. tall

1. Put bottom of post directly on next whole MIL line, in this case "1MIL line."
2. Put top of post into fractional measuring stadia.
3. Read fractional measurement plus whole measurement = 1-3/4 MIL Step Two

600

Angle Firing Numbers SL Thru 12K DA [+/- 1-25yds to nearest #]

| ANGLE | 300 | 350 | 400 | 450 | 500 | 550 | 600 | 650 | 700 | 750 | 800 | 850 | 900 |
|---|---|---|---|---|---|---|---|---|---|---|---|---|---|
| 5 | 290 | 340 | 390 | 440 | 490 | 539 | 588 | 636 | 683 | 731 | 780 | 829 | 878 |
| 10 | 285 | 335 | 385 | 434 | 484 | 532 | 581 | 628 | 675 | 721 | 768 | 816 | 865 |
| 15 | 280 | 330 | 380 | 429 | 478 | 525 | 574 | 621 | 668 | 711 | 754 | 803 | 852 |
| 20 | 275 | 322 | 370 | 418 | 468 | 511 | 554 | 602 | 649 | 694 | 740 | 785 | 831 |
| 25 | 270 | 315 | 360 | 408 | 459 | 497 | 535 | 582 | 630 | 677 | 725 | 768 | 810 |
| 30 | 265 | 310 | 355 | 398 | 442 | 480 | 518 | 562 | 607 | 653 | 700 | 742 | 785 |
| 35 | 260 | 305 | 350 | 382 | 425 | 462 | 500 | 543 | 585 | 630 | 675 | 718 | 760 |
| 40 | 250 | 287 | 325 | 358 | 400 | 440 | 480 | 520 | 560 | 600 | 640 | 680 | 720 |

Use Current DA For Firing Solution Boxes Shaded in Black Require 10K DA or Higher

| ANGLE | 950 | 1000 | 1050 | 1100 | 1150 | 1200 | 1250 | 1300 | 1350 | 1400 | 1450 | 1500 |
|---|---|---|---|---|---|---|---|---|---|---|---|---|
| 5 | 927 | 977 | 1025 | 1075 | 1123 | 1172 | 1220 | 1271 | 1320 | 1370 | 1417 | 1468 |
| 10 | 915 | 965 | 1014 | 1064 | 1114 | 1163 | 1212 | 1260 | 1307 | 1358 | 1405 | 1456 |
| 15 | 899 | 950 | 1000 | 1050 | 1099 | 1148 | 1194 | 1240 | 1289 | 1338 | 1387 | 1436 |
| 20 | 879 | 928 | 978 | 1027 | 1073 | 1120 | 1164 | 1207 | 1256 | 1306 | 1347 | 1400 |
| 25 | 855 | 900 | 950 | 1000 | 1045 | 1090 | 1132 | 1175 | 1222 | 1270 | 1315 | 1360 |
| 30 | 830 | 875 | 918 | 960 | 1005 | 1050 | 1092 | 1135 | 1180 | 1225 | 1270 | 1317 |
| 35 | 805 | 850 | 885 | 920 | 965 | 1010 | 1055 | 1100 | 1135 | 1176 | 1225 | 1275 |
| 40 | 760 | 800 | 832 | 910.4 | 954 | 997.6 | 1039 | 1080 | 1119 | 1161 | 1207 | 1210 |

DTUBB

Superior Shooting Systems (806) 323-9486

DA Adaptability

Compare VELOCITY and BULLET PATH columns to see the effect varying DA has on the bullet

2K

Trajectory for Sierra Bullets .308 dia. 175 gr. HPBT MatchKing at 2630 Feet per Second
At an Elevation Angle of: 0 degrees
Ballistic Coefficients of,. 0.605 0.496 0.485 0.485 0.485
Velocity Boundaries (Feet per Second) of: 2800 1800 1800 1800
Wind Direction Is: 3.0 o'clock and a Wind Velocity of: 0.0 Miles per hour
Wind Components are (Miles per Hour): DownRange: 0.0 Cross Range: 0.0 Vertical: 0.0
The Firing Point speed of sound is: 1111.05 fps
The bullet drops below the speed of sound on the trajectory (1111.27 fps) at: 1169 yards
Altitude: 0 Feet Humidity: 0 Percent Pressure: 27.82 In/Hg
Temperature: 50.5 F
Data Printed in English Units

| Range (Yards) | VELOCITY (Ft/Sec) | Energy (Ft/Lbs ) | Bullet Path (Inches) | BULLET PATH (1 MoA) | Wind Drift (inches) | Wind Drift (1 MoA) | Time of Flight (Seconds) |
|---|---|---|---|---|---|---|---|
| 0 | 2630 | 2687.3 | -2.8 | 0 | 0 | 0 | 0 |
| 100 | 2460.4 | 2352 | 0 | 0 | 0 | 0 | 0.1179 |
| 200 | 2297.1 | 2050 | -2.95 | -1.4 | 0 | 0 | 0.2441 |
| 300 | 2140 | 1779.2 | -12.5 | -4 | 0 | 0 | 0.3794 |
| 400 | 1989 | 1537.1 | -29.65 | -7.1 | 0 | 0 | 0.5249 |
| 500 | 1844.7 | 1322.1 | -55.61 | -10.6 | 0 | 0 | 0.6815 |
| 600 | 1705.6 | 1130.2 | -91.8 | -14.6 | 0 | 0 | 0.8506 |
| 700 | 1573.9 | 962.4 | -139.97 | -19.1 | 0 | 0 | 1.0338 |
| 800 | 1451.9 | 818.9 | -202.2 | -24.1 | 0 | 0 | 1.2323 |
| 900 | 1340.9 | 698.6 | -280.96 | -29.8 | 0 | 0 | 1.4475 |
| 1000 | 1242.8 | 600.1 | -379.08 | -36.2 | 0 | 0 | 1.6801 |
| 1100 | 1159.4 | 522.2 | -499.74 | -43.4 | 0 | 0 | 1.9304 |
| 1200 | 1091.5 | 462.8 | -646.28 | -51.4 | 0 | 0 | 2.1976 |

FIG. 14A

DA Adaptability

Compare VELOCITY and BULLET PATH columns to see the effect varying DA has on the bullet

3K

Trajectory for Sierra Bullets .308 dia. 175 gr. HPBT MatchKing at 2600 Feet per Second
At an Elevation Angle of: 0 degrees
Ballistic Coefficients of: 0.505 0.496 0.485 0.485 0.485
Velocity Boundaries (Feet per Second) of: 2800 1800 1800 1800
Wind Direction Is: 3.0 o'clock and a Wind Velocity of 0.0 Miles per hour
Wind Components are (Miles per Hour): DownRange: 0.0 Cross Range: 0.0 Vertical: 0.0
The Firing Point speed of sound Is: 1106.8 fps
The bullet drops below the speed of sound on the trajectory (1107.02 fps) at: 1191 yards
Altitude: 0 Feet Humidity: 0 Percent Pressure: 26.83 In/Hg
Temperature: 48.5999884741211 F
Data Printed In English Units

| Range (Yards) | VELOCITY (Ft/Sec) | Energy (Ft/Lbs) | Bullet Path (inches) | BULLET PATH (1 MoA) | Wind Drift (inches) | Wind Drift (1 MoA) | Time of Flight (Seconds) |
|---|---|---|---|---|---|---|---|
| 0 | 2600 | 2626.3 | -2.8 | 0 | 0 | 0 | 0 |
| 100 | 2436.5 | 2306.3 | 0 | 0 | 0 | 0 | 0.1192 |
| 200 | 2278.8 | 2017.5 | -3.06 | -1.5 | 0 | 0 | 0.2465 |
| 300 | 2126.9 | 1757.6 | -12.83 | -4.1 | 0 | 0 | 0.3828 |
| 400 | 1980.9 | 1524.6 | -30.3 | -7.2 | 0 | 0 | 0.529 |
| 500 | 1841.2 | 1317 | -56.64 | -10.8 | 0 | 0 | 0.6861 |
| 600 | 1706.1 | 1130.9 | -93.25 | -14.8 | 0 | 0 | 0.8553 |
| 700 | 1578 | 967.5 | -141.83 | -19.3 | 0 | 0 | 1.0382 |
| 800 | 1458.9 | 827 | -204.4 | -24.4 | 0 | 0 | 1.236 |
| 900 | 1350.2 | 708.2 | -283.33 | -30.1 | 0 | 0 | 1.4499 |
| 1000 | 1253.2 | 610.1 | -381.37 | -36.4 | 0 | 0 | 1.6808 |
| 1100 | 1169.8 | 531.6 | -501.57 | -43.5 | 0 | 0 | 1.9289 |
| 1200 | 1100.9 | 470.9 | -647.2 | -51.5 | 0 | 0 | 2.1937 |

FIG. 14B

DA Adaptability

Compare VELOCITY and BULLET PATH columns to see the effect varying DA has on the bullet

4K

Trajectory for Sierra Bullets .308 dia. 175gr. HPBT MatchKing at 2565 Feet per Second
At an Elevation Angle of: 0 degrees
Ballistic Coefficients ot: 0.505 0.496 0.485 0.485 0.485
Velocity Boundaries (Feat per Second) of: 2800 1800 1800 1800
Wind Direction is: 3.0 o'clock and a Wind Velocity of: 0.0 Miles per hour
Wind Components are (Miles per dour): DownRange: 0.0 Cross Range: 0.0 Vertical: 0.0
The Firing Point speed of sound is: 1103.95 fps
The bullet does not drop below the speed within the max range specified.
Altitude: 0 Feet Humidity: 0 Percent Pressure: 25.48 In/Hg
Temperature: 44 F
Data Printed In English Units

| Range (Yards) | VELOCITY (Ft/Sec) | Energy (Ft/Lbs) | Bullet Path (Inches) | BULLET PATH (1 MoA) | Wind Drift (inches) | Wind Drift (1 MoA) | Time of Flight (Seconds) |
|---|---|---|---|---|---|---|---|
| 0 | 2565 | 2556.1 | -2.8 | 0 | 0 | 0 | 0 |
| 100 | 2410.1 | 2256.8 | 0 | 0 | 0 | 0 | 0.1207 |
| 200 | 2260.6 | 1985.4 | -3.19 | -1.5 | 0 | 0 | 0.2492 |
| 300 | 2116.3 | 1740.1 | -13.2 | -4.2 | 0 | 0 | 0.3864 |
| 400 | 1977.4 | 1519.1 | -30.97 | -7.4 | 0 | 0 | 0.533 |
| 500 | 1844.1 | 1321.1 | -57.65 | -11 | 0 | 0 | 0.6901 |
| 600 | 1715 | 1142.8 | -94.57 | -15.1 | 0 | 0 | 0.8588 |
| 700 | 1592.1 | 984.8 | -143.33 | -19.6 | 0 | 0 | 1.040 |
| 800 | 1477.2 | 847.8 | -205.83 | -24.6 | 0 | 0 | 1.2361 |
| 900 | 1371.4 | 730.7 | -284.29 | -30.2 | 0 | 0 | 1.447 |
| 1000 | 1276 | 632.6 | -381.27 | -36.4 | 0 | 0 | 1.674 |
| 1100 | 1192.5 | 552.5 | -499.62 | -43.4 | 0 | 0 | 1.9175 |
| 1200 | 1122.1 | 489.2 | -642.45 | -51.1 | 0 | 0 | 2.1773 |

FIG. 14C

DA Adaptability

Compare VELOCITY and BULLET PATH columns to see the effect varying DA has on the bullet

5K

Trajectory for Sierra Bullets .308 dia. 175 gr. HPBT MatchKing at 2550 Feet per Second
At an Elevation Angle of: 0 degrees
Ballistic Coefficients of: 0.505 0.496 0.485 0.485 0.485
Velocity Boundaries (Feet per Second) of: 2800 1800 1800 1800
Wind Direction Is: 3.0 o'clock and a Wind Velocity of: 0.0 Miles per hour
Wind Components are (Miles per Hour): DownRange: 0.0 Cross Range: 0.0 Vertical: 0.0
The Firing Point speed of sound is: 1099.56 fps
The bullet does not drop below the speed within the max range specified.
Altitude: 0 Feet Humidity: 0 Percent Pressure: 24.88 In/fig
Temperature: 40 F
Data Printed In English Units

| Range (Yards) | VELOCITY (Ft/Sec) | Energy (Ft/Lbs) | Bullet Path (inches) | BULLET PATH (1 MoA) | Wind Drift (inches) | Wind Drift (1 MoA) | Time of Flight (Seconds) |
|---|---|---|---|---|---|---|---|
| 0 | 2550 | 2526.3 | -2.8 | 0 | 0 | 0 | 0 |
| 100 | 2398.3 | 2234.6 | 0 | 0 | 0 | 0 | 0.1224 |
| 200 | 2251.7 | 1969.9 | -3.25 | -1.6 | 0 | 0 | 0.2525 |
| 300 | 2110.2 | 1730.1 | -13.37 | -4.3 | 0 | 0 | 0.3909 |
| 400 | 1973.9 | 1513.8 | -31.3 | -7.5 | 0 | 0 | 0.5384 |
| 500 | 1843 | 1319.7 | -58.17 | -11.1 | 0 | 0 | 0.696 |
| 600 | 1716.1 | 1144.2 | -95.29 | -15.2 | 0 | 0 | 0.8646 |
| 700 | 1595.1 | 988.5 | -144.23 | -19.7 | 0 | 0 | 1.0455 |
| 800 | 1481.1 | 853 | -206.86 | -24.7 | 0 | 0 | 1.2398 |
| 900 | 1377.1 | 736.7 | -285.36 | -30.3 | 0 | 0 | 1.4485 |
| 1000 | 1282.2 | 638.8 | -382.21 | -36.5 | 0 | 0 | 1.6726 |
| 1100 | 1198.7 | 558.3 | -500.24 | -43.4 | 0 | 0 | 1.9124 |
| 1200 | 1127.8 | 494.1 | -642.5 | -51.5 | 0 | 0 | 2.1682 |

FIG. 15A

DA Adaptability

Compare VELOCITY and BULLET PATH columns to see the effect varying DA has on the bullet

6K

Trajectory for Sierra Bullets .308 dia. 175 gr. HPBT MatchKing at 2525 Feet per Second
At an Elevation Angle of: 0 degrees
Ballistic Coefficients of: 0.505 0.496 0.485 0.485 0.485
Velocity Boundaries (Feet per Second) of: 2800 1800 1800 1800
Wind Direction Is: 3.0 o'clock and a Wind Velocity of: 0.0 Miles per hour
Wind Components are (Miles per flour): DownRange: 0.0 Cross Range: 0.0 Vertical: 0.0
The Firing Point speed of sound Is: 1095.15 fps
The bullet does not drop below the speed within the max range specified.
Altitude: 0 Feet Humidity: 0 Percent Pressure: 23.97 In/Hg
Temperature: 36 F
Data Printed In English Units

| Range (Yards) | VELOCITY (Ft/Sec) | Energy (Ft/Lbs) | Bullet Path (inches) | BULLET PATH (1 MoA) | Wind Drift (Inches) | Wind Drift (1 MoA) | Time of Flight (Seconds) |
|---|---|---|---|---|---|---|---|
| 0 | 2525 | 2477 | -2.8 | 0 | 0 | 0 | 0 |
| 100 | 2378.7 | 2198.2 | 0 | 0 | 0 | 0 | 0.1224 |
| 200 | 2237.2 | 1944.4 | -3.35 | -1.6 | 0 | 0 | 0.2425 |
| 300 | 2100.4 | 1714 | -13.66 | -4.3 | 0 | 0 | 0.3909 |
| 400 | 1968.5 | 1505.5 | -31.85 | -7.6 | 0 | 0 | 0.5384 |
| 500 | 1841.7 | 1317.8 | -59.03 | -11.3 | 0 | 0 | 0.696 |
| 600 | 1718.6 | 1147.5 | -96.47 | -15.4 | 0 | 0 | 0.8646 |
| 700 | 1600.9 | 995.7 | -145.7 | -19.9 | 0 | 0 | 1.0455 |
| 800 | 1490.3 | 862.9 | -208.52 | -24.9 | 0 | 0 | 1.2398 |
| 900 | 1387.8 | 748.2 | -287.021 | -30.5 | 0 | 0 | 1.4485 |
| 1000 | 1294.3 | 650.8 | -383.59 | -36.6 | 0 | 0 | 1.6726 |
| 1100 | 1211.1 | 569.9 | -500.95 | -43.5 | 0 | 0 | 1.9124 |
| 1200 | 1139.6 | 504.6 | -642.05 | -51.1 | 0 | 0 | 2.1682 |

FIG. 15B

DA Adaptability

Another facet to contemplate: let us imagine you shot all your M118LR (175 gr. Sierra) and all that is left is G.I. M80 147-150 grain ball ammunition. Assigning a 4KDA to this round at 2740 fps we see it is useable to 900 yards with the DTAC reticle, other velocity assigned DA numbers also match.

Trajectory for Sierra Bullets .308 dia. 150 gr. HPBT MatchKing at 2740 Feet per Second
At an Elevation Angle of: 0 degrees
Ballistic Coefficients of: 0.417 0.397 0.355 0.355 0.355
Velocity Boundaries (Feet per Second) of: 2800 1800 1800 1800
Wind Direction is: 0.0 o'clock and a Wind Velocity of: 0.0 Miles per hour
Wind Components are (Miles per Hour): DownRange: 0.0 Cross Range: 0.0 Vertical Range: 0.0
The Firing Point speed of sound is: 1102.86 fps
The bullet does not drop below the speed within the max range specified.
Altitude: 0 Feet Humidity: 0 Percent Pressure: 25.84 In/Hg
Temperature: 43 F
Data Printed In English Units

| Range (Yards) | Velocity (Ft/Sec) | Energy (Ft/Lbs) | Bullet Path (Inches) | Bullet Path (1 MoA) | Wind Drift (Inches) | Wind Drift (1 MoA) | Time of Flight (Seconds) |
|---|---|---|---|---|---|---|---|
| 0 | 2740 | 2500.1 | -2.5 | 0 | 0 | 0 | 0 |
| 100 | 2536.6 | 2142.7 | 0 | 0 | 0 | 0 | 0.1138 |
| 200 | 2342.2 | 1826.9 | -2.91 | -1.4 | 0 | 0 | 0.2369 |
| 300 | 2156.4 | 1548.5 | -12.18 | -3.9 | 0 | 0 | 0.3704 |
| 400 | 1979 | 1304.3 | -28.94 | -6.9 | 0 | 0 | 0.5156 |
| 500 | 1810.8 | 1091.9 | -54.6 | -10.4 | 0 | 0 | 0.6741 |
| 600 | 1635.9 | 891.2 | -90.92 | -14.5 | 0 | 0 | 0.8484 |
| 700 | 1474.4 | 723.9 | -140.28 | -19.1 | 0 | 0 | 1.0417 |
| 800 | 1330.5 | 589.5 | -205.69 | -24.6 | 0 | 0 | 1.256 |
| 900 | 1207.8 | 485.8 | -290.78 | -30.9 | 0 | 0 | 1.493 |

FIG. 16

BALLISTIC EFFECT COMPENSATING RETICLE AND AIM COMPENSATION METHOD

PRIORITY CLAIMS AND CROSS-REFERENCE TO RELATED APPLICATIONS

This application claims priority to and is related to: (1) commonly owned U.S. provisional patent application No. 61/429,128, filed Jan. 1, 2011, (2) commonly owned U.S. provisional patent application No. 61/437,990, filed Jan. 31, 2011, (3) commonly owned U.S. patent application Ser. No. 13/342,197, filed Jan. 2, 2012 (now U.S. Pat. No. 8,701,330) and (4) commonly owned U.S. patent application Ser. No. 14/216,674 filed Mar. 17, 2014, the entire disclosures of which are incorporated herein by reference. This application is a Divisional application for copending allowed U.S. patent application Ser. No. 14/216,674.

BACKGROUND OF THE INVENTION

Field of the Invention

The present invention relates to optical instruments and methods for aiming a rifle, external ballistics and methods for predicting projectile's trajectory. This application relates to projectile weapon aiming systems such as rifle scopes, to reticle configurations for projectile weapon aiming systems, and to associated methods of compensating for a projectile's external ballistic behavior while developing a field expedient firing solution.

Discussion of the Prior Art

Rifle marksmanship has been continuously developing over the last few hundred years, and now refinements in materials and manufacturing processes have made increasingly accurate aimed fire possible. These refinements have made previously ignored environmental and external ballistics factors more significant as sources of aiming error.

The term "rifle" as used here, means a projectile controlling instrument or weapon configured to aim and propel or shoot a projectile, and rifle sights or projectile weapon aiming systems are discussed principally with reference to their use on rifles and embodied in telescopic sights commonly known as rifle scopes. It will become apparent, however, that projectile weapon aiming systems may include aiming devices other than rifle scopes, and may be used on instruments or weapons other than rifles which are capable of controlling and propelling projectiles along substantially pre-determinable trajectories (e.g., rail guns or cannon). The prior art provides a richly detailed library documenting the process of improving the accuracy of aimed fire from rifles (e.g., as shown in FIG. 1A) and other firearms or projectile weapons.

Most shooters or marksmen, whether hunting or target shooting, understand the basics. The primary factors affecting aiming accuracy are (a) the range or distance to the target which determines the arcuate trajectory or "drop" of the bullet in flight and the time of flight ("TOF"), and (b) the windage, wind deflection factors or lateral drift due to transverse or lateral forces acting on the bullet during TOF. All experienced marksmen account for these two factors when aiming. Precision long-range shooters such as military and police marksmen (or "snipers") often resort to references including military and governmental technical publications such as the following:

(Ref 1) Jonathan M. Weaver, Jr., LTC, USA Ret., Infantry, System Error Budgets, Target Distributions and Hitting Performance Estimates for General-Purpose Rifles and Sniper Rifles of 7.62×51 mm and Larger Calibers, AD-A228 398, TR-461, AMSAA, May, 1990;

(Ref 2) McCoy, Robert L., A Parametric Study of the Long Range, Special Application Sniper Rifle, Aberdeen Proving Grounds ("APG"), MD, BRL Memorandum Report No. 3558, December 1986;

(Ref 3) Brophy, William S., Maj., Ord., A Test of Sniper Rifles, 37th Report of Project No. TS2-2015, APG, MD D&PS, 27 Jul. 1955;

(Ref 4) Von Wahlde, Raymond & Metz, Dennis, Sniper Weapon Fire Control Error Budget Analysis, US Army ARL-TR-2065, August, 1999—arl.army.mil;

(Ref 5) US Army FM-23-10, Sniper Training, United States Army Infantry School ATSH-IN-S3, Fort Benning, Ga. 31905-5596, August 1994; and (Ref 6) USMC MCWP 3-15.3 (formerly FMFM 1-3B), Sniping, PCN 143 000118 00, Doctrine Division (C42) US Marine Corps Combat Development Command, 2 Broadway Street Suite 210 Quantico, Va. 22134-5021, May 2004.

For nomenclature purposes and to provide a more complete background and foundation for what follows, these published references are incorporated herein by reference.

A number of patented rifle sights or projectile weapon aiming systems have been developed to help marksmen account for the elevation/range and windage factors when aiming. For example, U.S. Pat. No. 7,603,804 (to Zadery et al) describes a riflescope made and sold by Leupold & Stevens, Inc., with a reticle including a central crosshair defined as the primary aiming mark for a first selected range (or "zero range") and further includes a plurality of secondary aiming marks spaced below the primary aiming mark on a primary vertical axis. Zadery's secondary aiming marks are positioned to compensate for predicted ballistic drop at selected incremental ranges beyond the first selected range, for identified groups of bullets having similar ballistic characteristics.

Zadery's rifle scope has variable magnification, and since Zadery's reticle is not in the first focal plane ("F1") the angles subtended by the secondary aiming marks of the reticle can be increased or decreased by changing the optical power of the riflescope to compensate for ballistic characteristics of different ammunition. The rifle scope's crosshair is defined by the primary vertical line or axis which is intersected by a perpendicular horizontal line or primary horizontal axis. The reticle includes horizontally projecting windage aiming marks on secondary horizontal axes intersecting selected secondary aiming marks, to facilitate compensation for the effect of crosswinds on the trajectory of the projectile at the selected incremental ranges At each secondary aiming mark on the primary vertical axis, the laterally or horizontally projecting windage aiming marks project symmetrically (left and right) from the vertical axis, indicating a windage correction for wind from the shooter's right and left sides, respectively.

Beyond bullet drop over a given range and basic left-right or lateral force windage compensation, there are several other ballistic factors which result in lesser errors in aiming. As the inherent precision of rifles and ammunition improves, it is increasingly critical that these other factors be taken into consideration and compensated for, in order to make an extremely accurate shot. These factors are especially critical at very long ranges, (e.g., approaching or beyond one thousand yards). Many of these other factors were addressed in this applicant's U.S. Pat. No. 7,325,353 (to Cole & Tubb) which describes a riflescope reticle including a plurality of charts, graphs or nomographs arrayed so a shooter can solve the ranging and ballistic problems required for correct estimation and aiming at a selected target. The '353 patent's scope reticle includes at least one aiming point field to allow a shooter to compensate for range (with elevation) and windage, with the "vertical" axis precisely diverging to compensate for "spin drift" and precession at longer ranges. Stadia for determining angular target dimension(s) are included on the reticle, with a nomograph for determining apparent distance from the apparent dimensions being provided either on the reticle or external to the scope. Additional nomographs are provided for the determination and compensation of non-level slopes, non-standard density altitudes, and wind correction, either on the reticle or external to the riflescope.

The elevation and windage aim point field (50) in the '353 patent's reticle is comparable, in one respect, to traditional bullet drop compensation reticles such as the reticle illustrated in the Zaderey '804 patent, but includes a number of refinements such as the compensated elevation or "vertical" crosshair 54, which can be seen to diverge laterally away from a true vertical reference line 56 (e.g., as shown in FIG. 3 of the '353 patent), to the right (i.e., for a rifle barrel with rifling oriented for right hand twist). The commercial embodiment of the '353 patent reticle is known as the DTAC™ Reticle, and the RET-2 version of the DTAC reticle is illustrated in FIG. 1C.

The compensated elevation or "vertical" crosshair of the DTAC™ reticle is useful for estimating the ballistic effect of the bullet's gyroscopic precession or "spin drift" caused by the bullet's stabilizing axial rotation or spin, which is imparted on the bullet by the rifle barrel's inwardly projecting helical "lands" which bear upon the bullet's circumferential surfaces as the bullets accelerates distally down the barrel. Precession or "spin drift" is due to an angular change of the axis of the bullet in flight as it travels an arcuate ballistic flight path. While various corrections have been developed for most of these factors, the corrections were typically provided in the form of programmable electronic devices or earlier in the form of logbooks developed over time by precision shooters. Additional factors affecting exterior ballistics of a bullet in flight include atmospheric variables, specifically altitude and barometric pressure, temperature, and humidity.

Traditional telescopic firearm sight reticles have been developed with markings to assist the shooter in determining the apparent range of a target. A nearly universal system has been developed by the military for artillery purposes, known as the "mil-radian," or "mil," for short. This system has been adopted by most of the military for tactical (e.g., sniper) use, and was subsequently adopted by most of the sport shooting world. The mil is an angle having a tangent of 0.001. A mil-dot scale is typically an array of dots (or similar indicia) arrayed along a line which is used to estimate or measure the distance to a target by observing the apparent target height or span (or the height or span of a known object in the vicinity of the target). For example, a target distance of one thousand yards would result in one mil subtending a height of approximately one yard, or thirty six inches, at the target. This is about 0.058 degree, or about 3.5 minutes of angle. It should be noted that although the term "mil-radian" implies a relationship to the radian, the mil is not exactly equal to an angle of one one thousandth of a radian, which would be about 0.057 degree or about 3.42 minutes of angle. The "mil-dot" system, based upon the mil, is in wide use in scope reticle marking, but does not provide a direct measure for determining the distance to a target without first having at least a general idea of the target size, and then performing a mathematical calculation involving these factors. Confusingly, the US Army and the US Marine Corps do not agree on these conversions exactly (see, e.g., Refs 5 and 6), which means that depending on how the shooter is equipped, the shooter's calculations using these conversions may change slightly.

The angular measurement known as the "minute of angle," or MOA is used to measure the height or distance subtended by an angle of one minute, or one sixtieth of one degree. At a range of one hundred yards, this subtended angle spans slightly less than 1.05 inches, or about 10.47 inches at one thousand yards range. It will be seen that the distance subtended by the MOA is substantially less than that subtended by the mil at any given distance, i.e. thirty six inches for one mil at one thousand yards but only 10.47 inches for one MOA at that range. Thus, shooters have developed a rather elaborate set of procedures to calculate required changes to sights (often referred to as "clicks") based on a required adjustment in a bullet's point of impact (e.g., as measured in "inches" or "minutes").

Sight adjustment and ranging methods have been featured in a number of patents Assigned to Horus Vision, LLC, including U.S. Pat. Nos. 6,453,595 and 6,681,512, each entitled "Gunsight and Reticle therefore" by D. J. Sammut and, more recently, U.S. Pat. No. 7,832,137, entitled "Apparatus and Method for Calculating Aiming Point Information" by Sammut et al. These patents describe several embodiments of the Horus Vision™ reticles, which are used in conjunction with a series of calculations to provide predicted vertical corrections (or holdovers) for estimated ranges and lateral corrections (or windage adjustments), where a shooter calculates holdover and windage adjustments separately, and then selects a corresponding aiming point on the reticle.

In addition to the general knowledge of the field of the present invention described above, the applicant is also aware of certain foreign references which relate generally to the invention. Japanese Patent Publication No. 55-36,823 published on Mar. 14, 1980 to Raito Koki Seisakusho KK describes (according to the drawings and English abstract) a variable power rifle scope having a variable distance between two horizontally disposed reticle lines, depending upon the optical power selected. The distance may be adjusted to subtend a known span or dimension at the target, with the distance being displayed numerically on a circumferential external adjustment ring. A prism transmits the distance setting displayed on the external ring to the eyepiece of the scope, for viewing by the marksman.

GENERAL & SPECIALIZED NOMENCLATURE

In order to provide a more structured background and a system of nomenclature, we refer again to FIGS. 1A-1E. FIG. 1A illustrates a projectile weapon system 4 including a rifle 6 and a telescopic rifle sight or projectile weapon aiming system 10. Telescopic rifle sight or rifle scope 10 are illustrated in the standard configuration where the rifle's barrel terminates distally in an open lumen or muzzle and rifle scope 10 is mounted upon rifle 6 in a configuration which allows the rifle system 4 to be "zeroed" or adjusted such that a user or shooter sees a Point of Aim ("POA") in substantial alignment with the rifle's Center of Impact ("COI") when shooting or firing selected ammunition (not shown) at a selected target (not shown).

FIG. 1B schematically illustrates exemplary internal components for telescopic rifle sight or rifle scope 10. The scope 10 generally includes a distal, objective lens 12 opposing a proximal ocular or eyepiece lens 14 at the ends of a rigid and substantially tubular body or housing, with a reticle screen or glass 16 disposed there-between. Variable power (e.g., 5-15 magnification) scopes also include an erector lens 18 and an axially adjustable magnification power adjustment (or "zoom") lens 20, with some means for adjusting the relative position of the zoom lens 20 to adjust the magnification power as desired, e.g. a circumferential adjustment ring 22 which threads the zoom lens 20 toward or away from the erector lens 18. Variable power scopes, as well as other types of telescopic sight devices, also often include a transverse position control 24 for transversely adjusting the reticle screen 16 to position an aiming point or center of the aim point field thereon (or adjusting the alignment of the scope 10 with the firearm 6), to adjust vertically for elevation (or bullet drop) as desired. Scopes also conventionally include a transverse windage adjustment for horizontal reticle screen control as well (not shown).

While an exemplary conventional variable power scope 10 is used in the illustrations, fixed power (e.g., 10×, such as the M3A scope) are often used. Such fixed power scopes have the advantages of economy, simplicity, and durability, in that they eliminate at least one lens and a positional adjustment for that lens. Such a fixed power scope may be suitable for many marksmen who generally shoot at relatively consistent ranges and targets.

Variable power scopes include two focal planes. The reticle screen or glass 16 used in connection with the reticles of the present invention is preferably positioned at the first or front focal plane ("FP1") between the distal objective lens 12 and erector lens 18, in order that the reticle thereon will change scale correspondingly with changes in magnification as the power of the scope is adjusted. This results in reticle divisions subtending the same apparent target size or angle, regardless of the magnification of the scope. In other words, a target subtending two reticle divisions at a relatively low magnification adjustment, will still subtend two reticle divisions when the power is adjusted, to a higher magnification, at a given distance from the target. This reticle location is preferred for the present system when used in combination with a variable power firearm scope.

Alternatively, reticle screen 16 may be placed at a second or rear focal plane between the zoom lens 20 and proximal eyepiece 14, if so desired. Such a second focal plane reticle will remain at the same apparent size regardless of the magnification adjustment to the scope, which has the advantage of providing a full field of view to the reticle at all times. However, the reticle divisions will not consistently subtend the same apparent target size with changes in magnification, when the reticle is positioned at the second focal plane in a variable power scope. Accordingly, it is preferred that the present system be used with first focal plane reticles in variable power scopes, due to the difficulty in using such a second focal plane reticle in a variable power scope.

FIG. 1C illustrates an earlier revision of applicant's DTAC™ rifle scope reticle, and provides a detailed view of an exemplary elevation and windage aim point field 30, with the accompanying horizontal and vertical angular measurement stadia 31. The aim point field 30 must be located on the scope reticle 16, as the marksman uses the aim point field 30 for aiming at the target as viewed through the scope and its reticle. Aim point field 30 comprises at least a horizontal line or crosshair 32 and a substantially vertical line or crosshair 34, which in the case of the field 30 is represented by a line of substantially vertical dots. A true vertical reference line (not shown) on aim point field 30 would vertical crosshair of the field 30, if so desired. It is noted that the substantially vertical central aiming dot line 34 is skewed somewhat to the right of a true vertical reference line (not shown) to compensate for gyroscopic precession or "spin drift" of the bullet in its trajectory. Most rifle barrels manufactured in the U.S. have "right hand twist" rifling which spirals to the right, or clockwise, from the proximal chamber to the distal muzzle of the rifle's barrel. This imparts a corresponding clockwise spin to the fired bullet, as an aid to stability and accuracy. As the fired bullet travels an arcuate trajectory in its ballistic flight between the rifle's muzzle and the target, the longitudinal axis of the bullet will deflect angularly to follow that arcuate trajectory. The spin of the bullet results in gyroscopic precession ninety degrees to the arcuate trajectory, causing the bullet to deflect to the right (for right hand twist barrels). This effect is seen most clearly at relatively long ranges, where there is substantial arc to the trajectory of the bullet, as shown in FIG. 1E. The offset or skewing of the vertical aiming dot line 34 to the right, in use, results in the marksman correspondingly moving the alignment slightly to the left in order to position one of the dots of the line 34 on the target (assuming no windage correction). This has the effect of correcting for the rightward deflection of the bullet due to gyroscopic precession.

The horizontal crosshair 32 and central aiming dot line 34 define a single aim point 38 at their intersection. The multiple aim point field 30 is formed of a series of horizontal rows which are seen in FIG. 1C to be exactly parallel to horizontal crosshair 32 and provide angled columns which are generally vertical (but spreading as they descend) to provide left side columns and right side columns of aiming dots (which may be small circles or other shapes, in order to minimize the obscuration of the target). It will be noted that the first and second uppermost horizontal rows actually comprise only a single dot each (including 38), as they provide relatively close-in aiming points for targets at only one hundred and two hundred yards, respectively. FIG. 1C's aim point field 30 is configured for a rifle and scope system which has initially been "zeroed" (i.e., adjusted to exactly compensate for the drop of the bullet during its flight) at a distance of two hundred yards, as evidenced by the primary horizontal crosshair 32. Thus, a marksman aiming at a closer target must lower his aim point to one of the dots slightly above the horizontal crosshair 32, as relatively little drop occurs to the bullet in such a relatively short flight.

Most of the horizontal rows in FIG. 1C's aim point field 30 are numbered along the left edge of the aim point field to indicate the range in hundreds of yards for an accurate shot using the dots of that particular row (e.g., "3" for 300 yards and "4" for 400 yards). The spacing between each horizontal row gradually increases as the range becomes longer and longer. This is due to the slowing of the bullet and increase in vertical speed due to the acceleration of gravity during the bullet's flight, (e.g., as illustrated in FIG. 1E). The alignment and spacing of the horizontal rows compensates for these factors at the selected ranges. In a similar manner, the angled, generally vertical columns spread as they extend downwardly to greater and greater ranges. These generally vertical columns are intended to provide aim points which compensate for windage, i.e. the lateral drift of a bullet due to any crosswind component. A crosswind will have an ever greater effect upon the path of a bullet with longer and longer range or distance. The scope reticle of FIG. 1C includes approximate "lead" indicators "W" (for a target moving at a slow, walking speed) and "R" (farther from the central aim point 38, for running targets).

In order to use the Tubb™ DTAC™ elevation and windage aim point field 30, the marksman must have a reasonably close estimate of the range to the target. This can be provided by means of the evenly spaced horizontal and vertical angular measurement stadia 31 disposed upon aim point field 30. The stadia 31 comprise a vertical row of stadia alignment markings and a horizontal row of such markings disposed along the horizontal reference line or crosshair 32. Each adjacent stadia mark, e.g. vertical marks and horizontal marks are evenly spaced from one another and subtend precisely the same angle therebetween, e.g. one mil, or a tangent of 0.001. Other angular definitions may be used as desired, e.g. the minute of angle or MOA system discussed above. The DTAC™ stadia system 31 is used by estimating some dimension of the target, or of an object close to the target. It should be noted that each of the stadia markings comprises a small triangular shape, and provides a precise, specific alignment line, to reduce errors in subtended angle estimation, and therefore in estimating the distance to the target.

FIG. 1D illustrates a rifle scope reticle which is similar in many respects to the reticle of FIG. 1C and applicant's previous DTAC™ Reticle, as described and illustrated in applicant's own U.S. Pat. No. 7,325,353, in the prior art. FIG. 1D provides a detailed view of an exemplary elevation and windage aim point field 50, with the accompanying horizontal and vertical angular measurement stadia 100. The aim point field 50 must be located on the scope reticle, as the marksman uses the aim point field 50 for aiming at the target as viewed through the scope and its reticle. The aim point field 50 comprises at least one horizontal line or crosshair 52 and a substantially vertical central aiming dot line or crosshair 54, which in the case of the field 50 is represented by a line of substantially or nearly vertical dots. A true vertical reference line 56 is shown on the aim point field 50 of FIG. 1D, and may comprise the vertical crosshair of the reticle aim point field 50, if so desired.

It will be noted that the substantially vertical central aiming dot line 54 is skewed somewhat to the right of the true vertical reference line 56. As above, this is to compensate for gyroscopic precession or "spin drift" of a spin-stabilized bullet or projectile in its trajectory. The flying bullet's clockwise spin results in gyroscopic precession which generates a force that is transverse or normal (i.e., ninety degrees) to the arcuate trajectory, causing the bullet to deflect to the right. As above, the lateral offset or skewing of substantially vertical central aiming dot line to the right causes the user, shooter or marksman to aim or moving the alignment slightly to the left in order to position one of the aiming dots of the central line 54 on the target (assuming no windage correction).

FIG. 1D shows how horizontal crosshair 52 and substantially vertical central aiming dot line 54 define a single aim point 58 at their intersection. The multiple aim point 50 is formed of a series of horizontal rows which are exactly parallel to horizontal crosshair 52 (60*a*, 60*b*, 60*c*, etc.) and angled but generally vertical (spreading as they descend) to provide left side columns 62*a*, 62*b*, 62*c*, etc. and right side columns 64*a*, 64*b*, 64*c*, etc. of aiming dots (which may be small circles or other shapes, in order to minimize the obscuration of the target). It will be noted that the two uppermost horizontal rows 60*a* and 60*b* actually comprise only a single dot each, as they provide relatively close aiming points at only one hundred and two hundred yards, respectively. FIG. 1D's aim point field 50 is configured for a rifle and scope system (e.g., 4) which has been "zeroed" (i.e., adjusted to exactly compensate for the drop of the bullet during its flight) at a distance of three hundred yards, as evidenced by the primary horizontal crosshair 52. Thus, a marksman aiming at a closer target must lower his aim point to one of the dots 60*a* or 60*b* slightly above the horizontal crosshair 52, as relatively little drop occurs to the bullet in such a relatively short flight.

In FIG. 1D, most of the horizontal rows, e.g. rows 60*d*, 60*e*, 60*f*, 60*g*, down to row 60*n*, are numbered to indicate the range in hundreds of yards for an accurate shot using the dots of that particular row. The row 60*i* has a horizontal mark to indicate a range of one thousand yards. It will be noted that the spacing between each horizontal row 60*c*, 60*d*, 60*e*, 60*f*, etc., gradually increases as the range becomes longer and longer. This is due to the slowing of the bullet and increase in vertical speed due to the acceleration of gravity during its flight. The alignment and spacing of the horizontal rows nearly compensates for these factors, such that the vertical impact point of the bullet will be more nearly accurate at the selected range. In a similar manner, the generally vertical columns 62*a*, 62*b*, 64*a*, 64*b*, etc., spread as they extend downwardly to greater and greater ranges. These generally vertical columns are provided as an aiming aid permitting the shooter to compensate for windage, i.e. the lateral drift of a bullet due to any crosswind component. A crosswind will have an ever greater effect upon the path of a bullet with longer and longer range or distance, so the vertical columns spread with greater ranges or distances, with the two inner columns 62*a*, 64*a* closest to the central column 54 being spaced to provide correction for a five mile per hour crosswind component, while the next two adjacent columns 62*b*, 64*b* providing an estimated correction for a ten mile per hour crosswind component. Long range, high wind aim point estimation is known to the most difficult problem among experienced marksman, even if the wind is relatively steady over the entire flight path of the bullet.

Both of the reticles discussed above represent significant aids for precision shooting over long ranges, such as the ranges depicted in FIG. 1E, (which duplicates the information in FIG. 3-25 of Ref 5). As noted above, FIG. 1E is a trajectory chart taken from a U.S. Gov't publication which illustrates the trajectory of a selected 7.62×51 (or 7.62 NATO) projectile fired from an M24 SWS rifle for sight adjustment or "zero" settings from 300 meters to 1000 meters. This chart was originally developed as a training aid for military marksmen (e.g., snipers) and illustrates the "zero wind" trajectory for the US M118 7.62 NATO (173 gr FMJBT) projectile. The chart is intended to illustrate the arcuate trajectory of the bullet, in flight, and shows the relationship between a "line of sight" and the bullet's trajectory between the shooter's position and a target, for eight different "zero" or sight adjustment ranges, namely, 300 M, 400 M, 500 M, 600 M, 700 M, 800 M, 900 M, and 1000 M. As illustrated in FIG. 1E, if a shooter is "zeroed" for a target at 300 M and shoots a target at 300 M, then the highest point of flight in the bullet's trajectory is 6.2 inches and the bullet will strike a target at 400 M 14 inches low. This is to be contrasted with a much longer range shot. For example, as illustrated in FIG. 1E, if a shooter is "zeroed" for a target at 900 M and shoots a target at 900 M, then the highest point of flight in the bullet's trajectory is 96.6 inches (over 8 feet) and the bullet will strike a target at 1000 M (or 1.0 KM) 14 inches low. For a target at 1000 M the highest point of flight in the bullet's trajectory is 129 inches (almost 11 feet) above the line of sight, and, at these ranges, the bullet's trajectory is clearly well above the line of sight for a significant distance, and the bullet's time of flight ("TOF") is long enough that the time for the any cross wind to act on the bullet is a more significant factor.

The above described systems are now in use in scope reticles, but these prior art systems have been discovered to include subtle but significant errors arising from recently observed external ballistic phenomena, and the observed error has been significant (e.g., exceeding one MOA) at ranges well within the operationally significant military or police sniping range limits (e.g., 1000 yards). The prior art systems often require the marksman or shooter to bring a companion (e.g., a coach or spotter) who may be required to bring additional optics for observation and measurement and may also be required to bring along computer-like devices such as a transportable personal digital assistant ("PDA") or a smart phone (e.g., an iPhone™ or a Blackberry™ programmed with an appropriate software application or "app") for solving ballistics problems while in the field.

These prior art systems also require the marksman or their companion to engage in too many evaluations and calculations while in the field, and even for experienced long-range shooters, those evaluations and calculations usually take up a significant amount of time. If the marksman is engaged in military or police tactical or sniping operations, lost time when aiming may be extremely critical, (e.g., as noted in Refs 5 and 6).

None of the above cited references or patents, alone or in combination, address the combined atmospheric and ballistic problems identified by the applicant of the present invention or provide a workable and time-efficient way of developing a firing solution, while in the field. Thus, there is an unmet need for a rapid, accurate and effective rifle sight or projectile weapon aiming system and method for more precisely estimating a correct point of aim when shooting or engaging targets at long distances, especially in windy conditions.

OBJECTS AND SUMMARY OF THE INVENTION

Accordingly, it is an object of the present invention to overcome the above mentioned difficulties by providing a rapid and effective system and method for compensating for a projectile's ballistic behavior while developing a field expedient firing solution, and estimating a correct point of aim when shooting or engaging targets at long distances.

The applicant has engaged in a rigorous study of precision shooting and external ballistics and observed what initially appeared to be external ballistics anomalies when engaged in carefully controlled experiments in precise shooting at long range. The anomalies were observed to vary with environmental or atmospheric conditions, especially crosswinds. The variations in the anomalies were observed to be repeatable, and so a precise evaluation of the anomalies was undertaken and it was discovered that all of the long range reticles presently employed in the prior art systems are essentially wrong.

A refined method and aiming reticle has been developed which allows a more precise estimate of external ballistic behavior for a given projectile when a given set of environmental or atmospheric conditions are observed to be momentarily present. Expressed most plainly, the reticle of the present invention differs from prior art long range reticles in two significant and easily perceived ways:

first, the reticle and system of the present invention is configured to compensate for Crosswind Jump, and so the lateral or windage aim point adjustment axes are not horizontal, meaning that they are not simply horizontal straight lines which are perpendicular to a vertical straight line crosshair; and second, the reticle and system of the present invention is configured to compensate for Dissimilar Wind Drift, and so the arrayed aim point indicators on each windage adjustment axis are not spaced symmetrically about the vertical crosshair, meaning that a given wind speed's full value windage offset indicator on the left side of the vertical crosshair is not spaced from the vertical crosshair at the same lateral distance as the corresponding given wind speed's full value windage offset indicator on the right side of the vertical crosshair.

Apart from the Tubb™ DTAC™ reticle discussed above, the reticles of the prior art have a vertical crosshair or post intended to be seen (through the riflescope) as being exactly perpendicular to a horizontal crosshair that is parallel to the horizon when the rifle is held level with no angular variation from vertical (or "rifle cant"). Those prior art reticles also include a plurality of "secondary horizontal crosshairs" (e.g., 24 in FIG. 2 of Sammut's U.S. Pat. No. 6,453,595). The secondary horizontal crosshairs are typically divided with evenly spaced indicia on both sides of the vertical crosshair (e.g., 26 in FIG. 2 of Sammut's U.S. Pat. No. 6,453,595 or as shown in FIG. 3 of this applicant's U.S. Pat. No. 7,325,353). These prior art reticles represent a prediction of where a bullet will strike a target, and that prior art prediction includes an assumption or estimation that a windage offset to the left is going to be identical to and symmetrical with a windage offset to the right, and that assumption is plainly, provably wrong, for reasons supported in the more arcane technical literature on ballistics and explained below.

Another assumption built into the prior art reticles pertains to the predicted effect on elevation arising from increasing windage adjustments, because the prior art reticles effectively predict that no change in elevation (i.e., holdover) should be made, no matter how much windage adjustment is needed. This second assumption is demonstrated by the fact that the prior art reticles all have straight and parallel "secondary horizontal crosshairs" (e.g., 24 in FIG. 2 of Sammut's U.S. Pat. No. 6,453,595 or as shown in FIG. 3 of this applicant's U.S. Pat. No. 7,325,353), and that assumption is also plainly, provably wrong.

The applicant of the present invention first questioned and then discarded these assumptions, choosing instead to empirically observe, record and plot the actual ballistic performance for a series of carefully controlled shots at selected ranges, and the plotted observations have been used to develop an improved method and reticle which provides a more accurate predictor of the effects of observed atmospheric and environmental conditions on a bullet's external ballistics, especially at longer ranges. The applicant's discoveries are combined into a reticle which provides easy to use and accurate estimations of the external ballistic effects of (a) spin drift, (b) crosswind jump or aeronautical jump and (c) dissimilar wind drift.

The rifle sight or projectile weapon aiming system reticle of the present invention preferably includes an array of aiming dots defining a substantially vertical crosshair and an array of lateral indicia defining a horizontal crosshair which intersect to define a central or primary aiming point. The reticle of the present invention also includes a plurality of substantially linear windage adjustment axes arrayed beneath the horizontal crosshair. The windage adjustment axes are not horizontal lines, meaning that they are not secondary horizontal crosshairs each being perpendicular to the vertical crosshair. Instead, each windage axis defines an angled or sloped array of windage offset adjustment indicia or aim points. If a windage axis line were drawn left to right through all of the windage offset adjustment indicia corresponding to a selected range (e.g., 800 yards), that windage axis line would slope downwardly from horizontal at a small angle (e.g., five degrees or greater), for a rifle barrel with right-hand twist rifling and a right-spinning projectile.

In addition, the windage offset adjustment indicia on each windage adjustment axis are not symmetrical about the vertical crosshair, meaning that selected windage offset adjustment indicator on the left side of the vertical crosshair is not spaced from the vertical crosshair at the same lateral distance as the corresponding windage offset adjustment indicator on the right side of the vertical crosshair. Instead, the reticle and method of the present invention define differing windage offsets for (a) wind from the left and (b) wind from the right. Those windage offsets refer to an elevation adjustment axis which diverges laterally from the vertical crosshair. The elevation adjustment axis defines the diverging array of elevation offset adjustment indicia for selected ranges (e.g., 300 to 1600 yards, in 100 yard increments). An elevation offset adjustment axis line could be drawn through all of the elevation offset adjustment indicia (corresponding to no wind) to define only the predicted effect of spin drift and precession, as described in this applicant's U.S. Pat. No. 7,325,353.

In accordance with the present invention, a reticle system and aiming method are provided to account for the previously ill-defined effects of the newly observed interaction between ballistic and atmospheric effects. Careful research of technical journals was used to find reports of identified effects in disparate sources, but those effects have never been addressed in a comprehensive system to provide an aiming solution or estimate which can be used by a marksman in the field.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

BRIEF DESCRIPTION OF THE DRAWINGS

FIG. 6 illustrates a two-sided placard summarizing selected ballistics correction factors in a first and second tables for use with any projectile weapon including a rifle scope having a standard mil-dot reticle, for a specific cartridge, in accordance with the method of the present invention.

FIGS. 14A, 14B, 14C, 15A, 15B and 16 illustrate exemplary transportable placards summarizing ballistics information about a selected projectile for use in finding Density Altitude ("DA") adaptability factors as part of the aim compensation method of the present invention.

DETAILED DESCRIPTION OF THE PREFERRED EMBODIMENTS

Figure 1A:
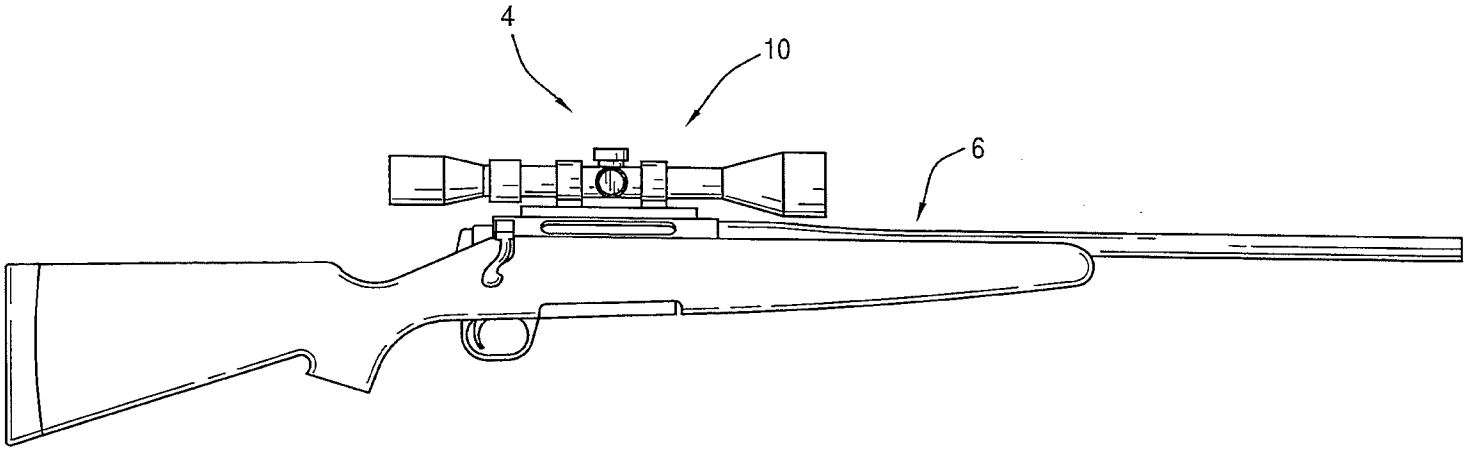
FIG. 1A PRIOR ART
FIG. 1A illustrates a typical rifle with a rifle scope, or more generally, a sight or projectile weapon aiming system.

Referring again to FIGS. 1A-1E. FIG. 1A's projectile weapon system 4 including a rifle 6 and a telescopic rifle sight or projectile weapon aiming system 10 are illustrated in the standard configuration where the rifle's barrel terminates distally in an open lumen or muzzle and rifle scope 10 is mounted upon rifle 6 in a configuration which allows the rifle system 4 to be adjusted such that a user or shooter sees a Point of Aim ("POA") in substantial alignment with the rifle's Center of Impact ("COI") when shooting or firing selected ammunition (not shown) at a selected target (not shown).

Figure 1B:
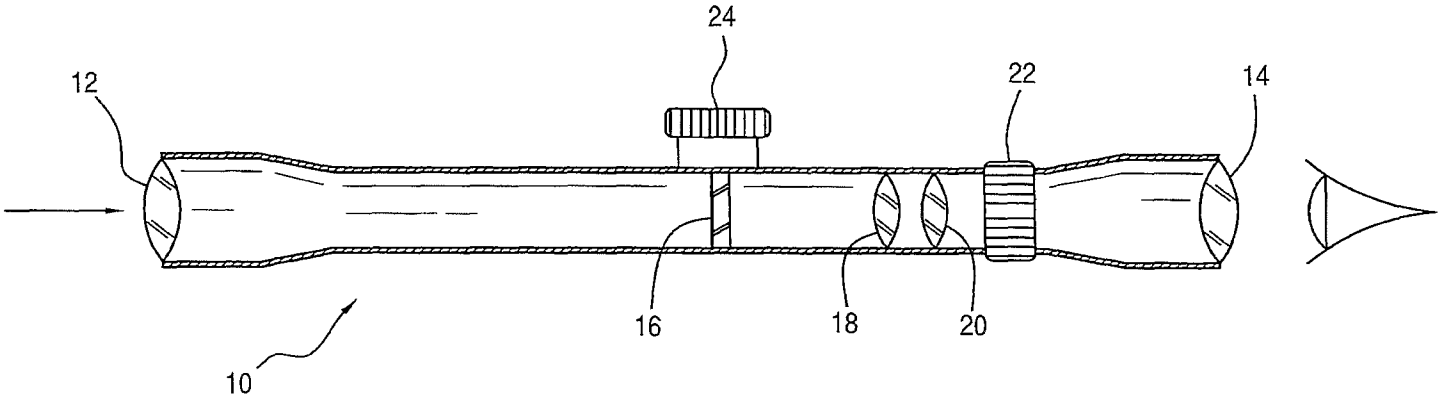
FIG. 1B PRIOR ART
FIG. 1B illustrates a schematic view in cross section of the basic internal elements of a typical rifle scope such as the rifle scope of FIG. 1A.

FIG. 1B schematically illustrates exemplary internal components for telescopic rifle sight or projectile weapon aiming system 10, with which the reticle and system of the present invention may also be used. As noted above, rifle scope 10 generally includes a distal objective lens 12 opposing a proximal ocular or eyepiece lens 14 at the ends of a rigid and substantially tubular body or housing, with a reticle screen or glass 16 disposed there-between. Variable power (e.g., 5-15 magnification) scopes also include an erector lens 18 and an axially adjustable magnification power adjustment (or "zoom") lens 20, with some means for adjusting the relative position of the zoom lens 20 to adjust the magnification power as desired, e.g. a circumferential adjustment ring 22 which threads the zoom lens 20 toward or away from the erector lens 18. Variable power scopes, as well as other types of telescopic sight devices, also often include a transverse position control 24 for transversely adjusting the reticle screen 16 to position an aiming point or center of the aim point field thereon (or adjusting the alignment of the scope 10 with the firearm 6), to adjust vertically for elevation (or bullet drop) as desired. Scopes also conventionally include a transverse windage adjustment for horizontal reticle screen control as well (not shown).

While an exemplary conventional variable power scope 10 is used in the illustrations, it will be understood that the reticle and system of the present invention may be used with other types of sighting systems or scopes in lieu of the variable power scope 10. For example, fixed power scopes are often used by many hunters and target shooters. Such fixed power scopes have the advantages of economy, simplicity, and durability, in that they eliminate at least one lens and a positional adjustment for that lens. Such a fixed power scope may be suitable for many marksmen who generally shoot at relatively consistent ranges and targets. More recently, digital electronic scopes have been developed, which operate using the same general principles as digital electronic cameras. The ballistic effect compensating reticle and aim compensation method for rifle sights or projectile weapon aiming systems of the present invention (and as set forth in the appended claims) may be employed with these other types of sighting systems or scopes, as well as with the variable power scope 10 of FIGS. 1A and 1B.

While variable power scopes typically include two focal planes, the reticle screen or glass 16 used in connection with the reticles of the present invention is preferably positioned at the first or front focal plane ("FP1") between the distal objective lens 12 and erector lens 18, in order that the reticle thereon will change scale correspondingly with changes in magnification as the power of the scope is adjusted. This results in reticle divisions subtending the same apparent target size or angle, regardless of the magnification of the scope. In other words, a target subtending two reticle divisions at a relatively low magnification adjustment, will still subtend two reticle divisions when the power is adjusted, to a higher magnification, at a given distance from the target. This reticle location is preferred for the present system when used in combination with a variable power firearm scope.

Alternatively, reticle screen 16 may be placed at a second or rear focal plane between the zoom lens 20 and proximal eyepiece 14, if so desired. Such a second focal plane reticle will remain at the same apparent size regardless of the magnification adjustment to the scope, which has the advantage of providing a full field of view to the reticle at all times. However, the reticle divisions will not consistently subtend the same apparent target size with changes in magnification, when the reticle is positioned at the second focal plane in a variable power scope. Accordingly, it is preferred that the present system be used with first focal plane reticles in variable power scopes, due to the difficulty in using such a second focal plane reticle in a variable power scope.

Figure 1C:
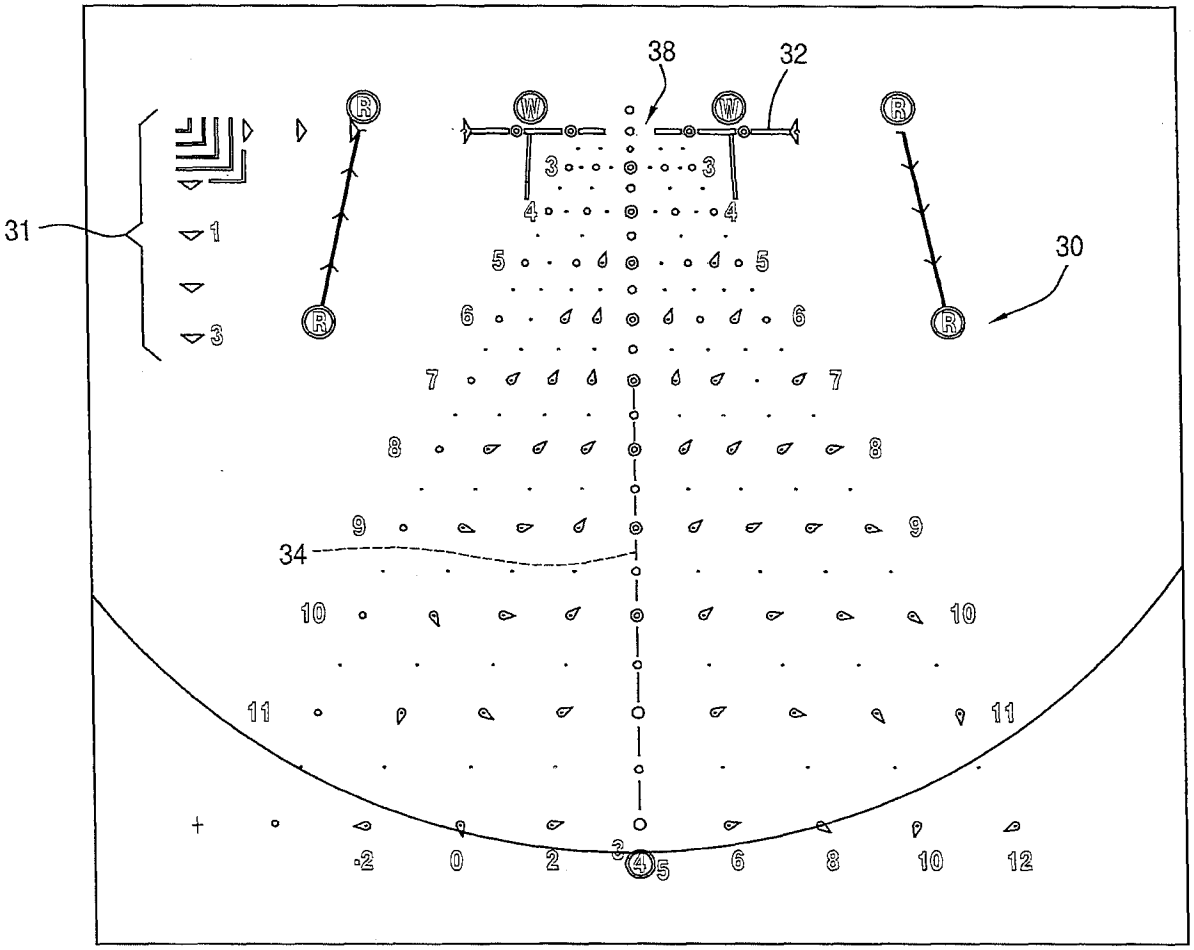
FIG. 1C PRIOR ART
FIG. 1C illustrates a rifle scope reticle for use in the rifle scope of FIGS. 1A and 1B, and having an earlier revision of applicant's DTAC™ reticle elevation and windage aim point field, as seen in the prior art.
Figure 1D:
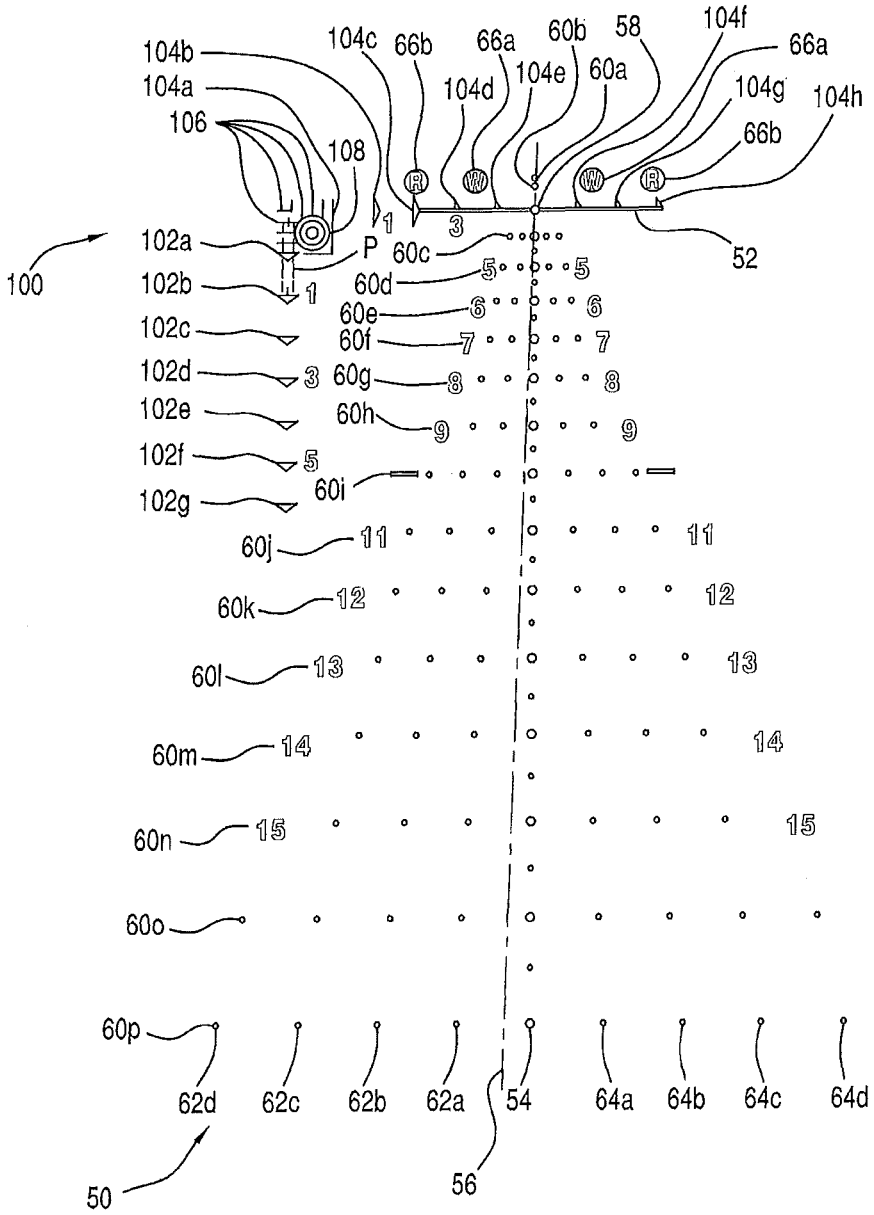
FIG. 1D PRIOR ART
FIG. 1D illustrates a rifle scope reticle for use in the rifle scope of FIGS. 1A and 1B, and applicant's previous DTAC™ Reticle, as described and illustrated in applicant's own U.S. Pat. No. 7,325,353, in the prior art.
Figure 1E:
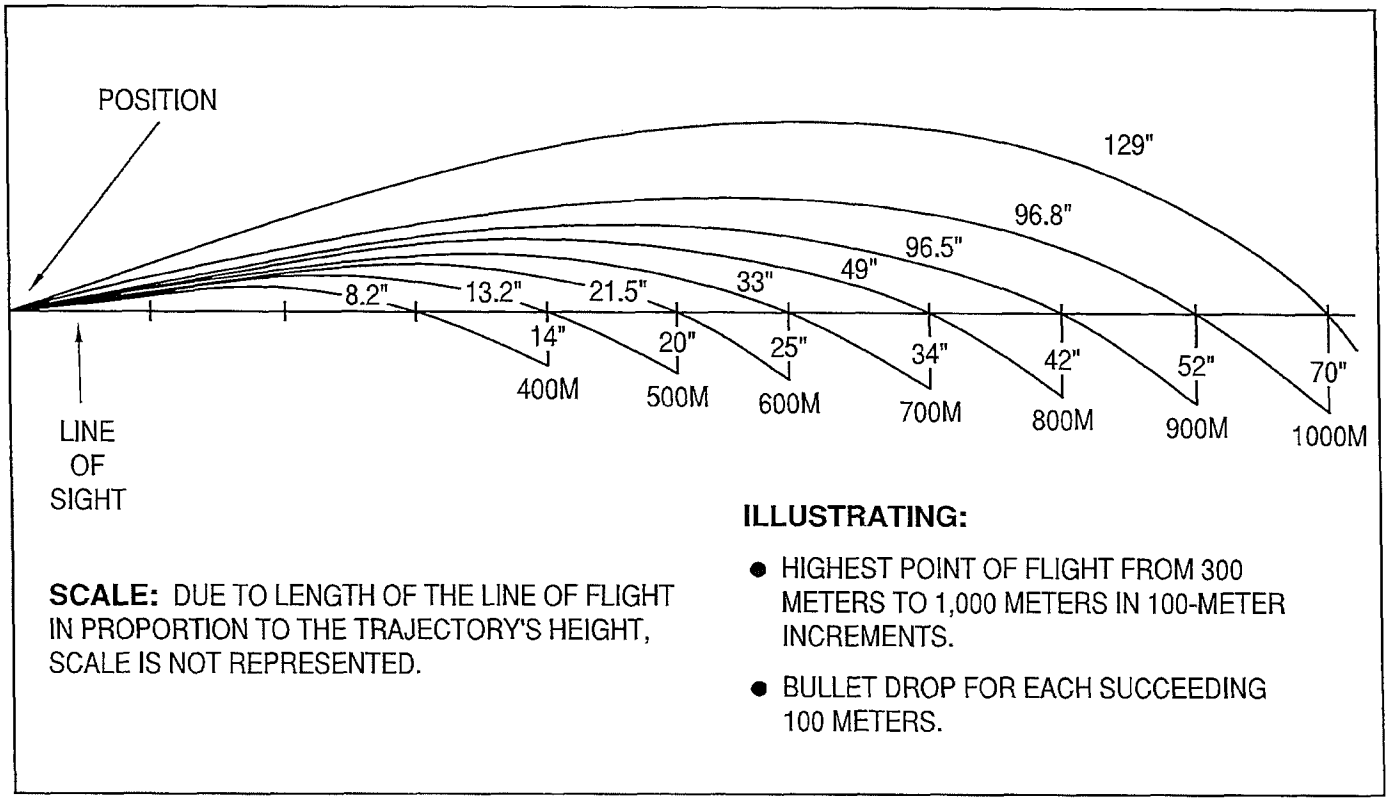
FIG. 1E is a chart taken from a U.S. Gov't publication which illustrates the trajectory of a selected 7.62×51 (or 7.62 NATO) projectile for sight adjustment or "zero" settings from 300 meters to 1000 meters, as found in the prior art.
Figure 2:
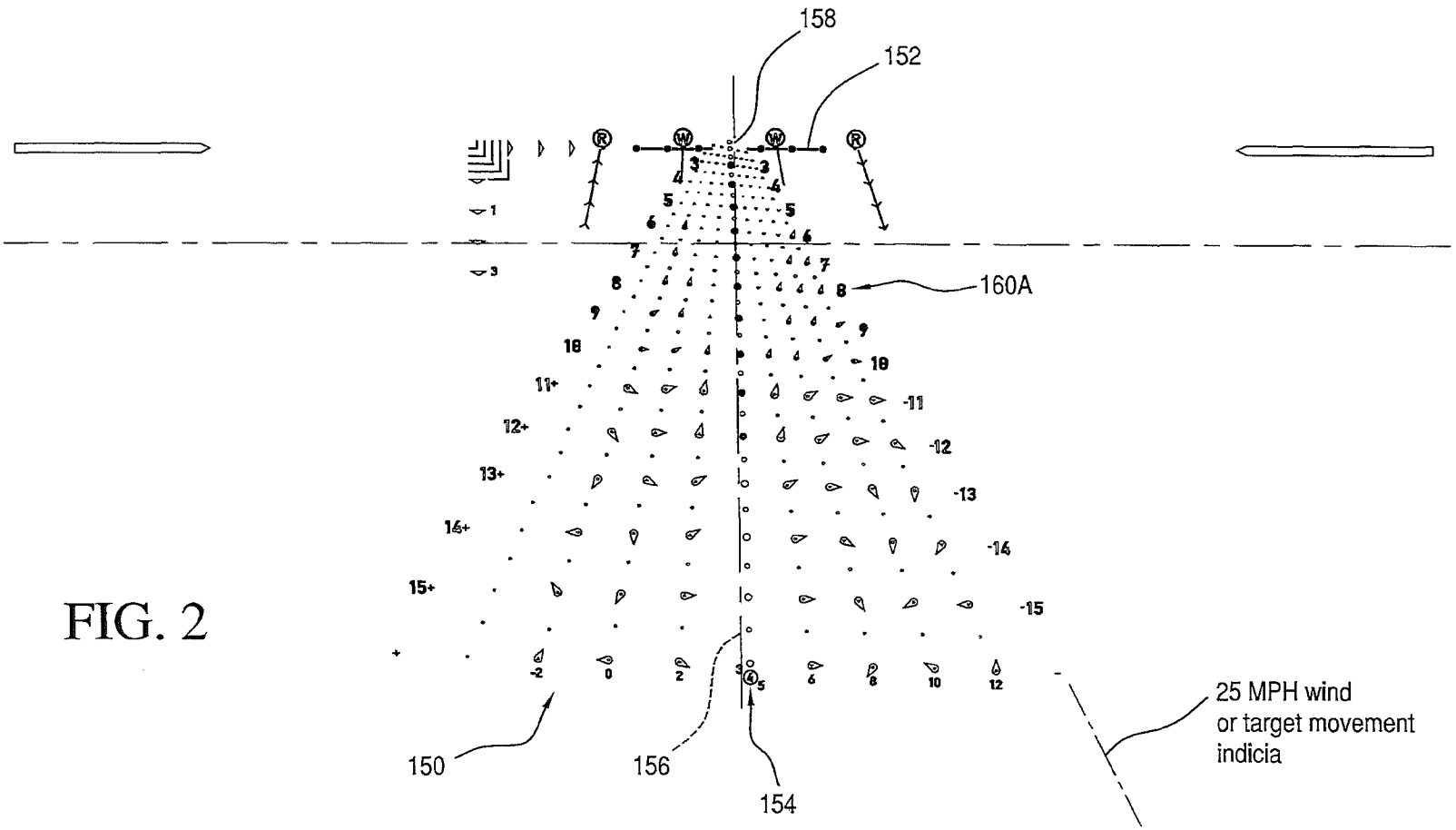
FIG. 2 illustrates a ballistic effect compensating system or reticle for use with an aim compensation method for rifle sights or projectile weapon aiming systems which is readily adapted for use with any projectile weapon, and especially with a rifle scope such as that illustrated in FIGS. 1A and 1B, in accordance with the present invention.

As noted above, the applicant's prior art DTAC™ reticles (shown in FIGS. 1C and 1D) provided improved aids to precision shooting over long ranges, such as the ranges depicted in FIG. 1E. But more was needed. FIG. 1E is a trajectory chart originally developed as a training aid for military marksmen (e.g., snipers) and illustrates the "zero wind" trajectory for the selected projectile. The chart was intended to illustrate the arcuate trajectory of the bullet, in flight, and shows the relationship between a "line of sight" and the bullet's trajectory between the shooter's position and a target, for the illustrated "zero" or sight adjustment ranges (e.g., 300 M, 400 M, 500 M, 600 M, 700 M, 800 M, 900 M, and 1000 M). As illustrated in FIG. 1E, if a shooter is "zeroed" for a target at 300 M and shoots a target at 300 M, then the highest point of flight in the bullet's trajectory is 6.2 inches and the bullet will strike a target at 400 M 14 inches low. This is to be contrasted with a much longer range shot. For example, as illustrated in FIG. 1E, if a shooter is "zeroed" for a target at 900 M and shoots a target at 900 M, then the highest point of flight in the bullet's trajectory is 96.6 inches (over 8 feet!) and the bullet will strike a target at 1000 M (or 1.0 KM) 14 inches low. For a target at 1000 M the highest point of flight in the bullet's trajectory is 129 inches (almost 11 feet!) above the line of sight, and, at these ranges, the bullet's trajectory is clearly well above the line of sight for a significant distance, and the bullet's time of flight ("TOF") is long enough that the time for the any cross wind to act on the bullet is a more significant factor. The applicant observed that crosswinds at elevations so far above the line of sight vary significantly from the winds closer to the line of sight (and thus above the earth's surface). In the study of fluid dynamics, scientists, engineers and technicians differentiate between fluid flow near "boundary layers" (such as the earth) and fluid flow which is unaffected by static boundaries and thus provides "laminar" or non-turbulent flow. The ballistic effect compensating system and the reticle of FIGS. 2, 3 & 4, is configured to aid the shooter by provided long-range aim points which predict the effects of recently studied combined ballistic and atmospheric effects, and the inter-relationship of these external ballistic effects as observed and recorded by the applicant have been plotted as part of the development work for the new reticle of the present invention.

Figure 3:
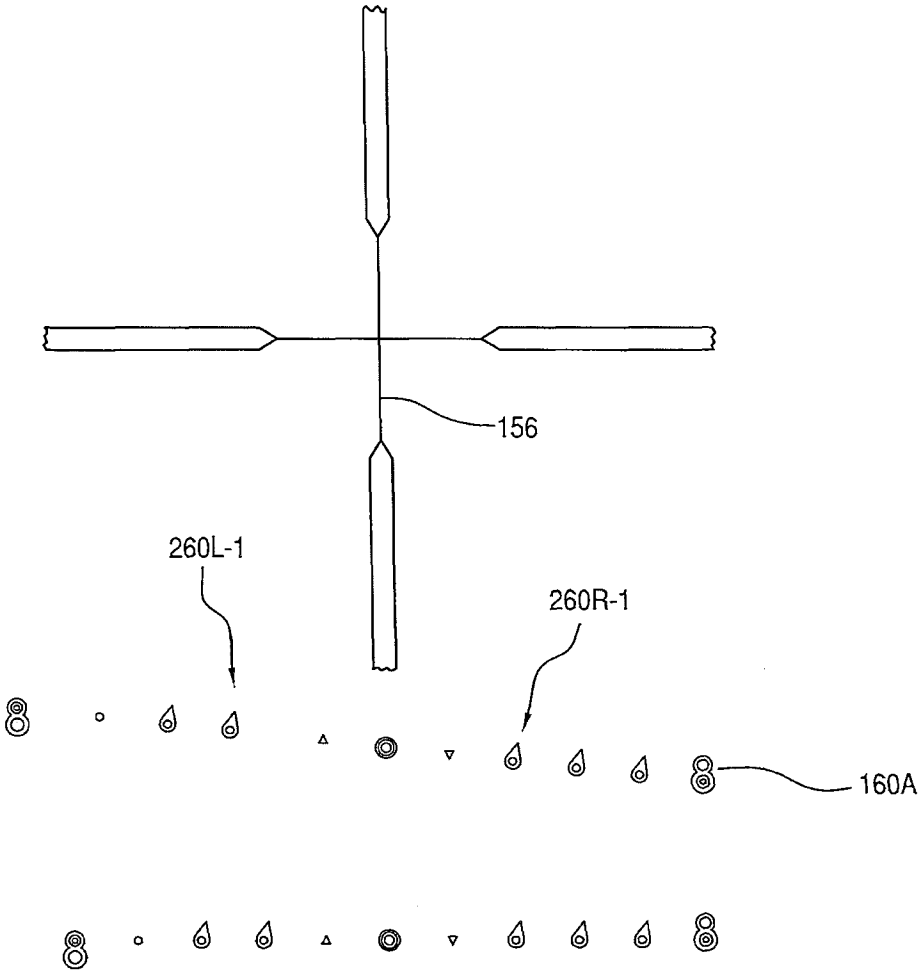
FIG. 3 illustrates a ballistic effect compensating system and aim compensation method for rifle sights or projectile weapon aiming systems which is readily adapted for use with any projectile weapon, and especially with a rifle scope such as that illustrated in FIGS. 1A and 1B, in accordance with the present invention.
Figure 4:
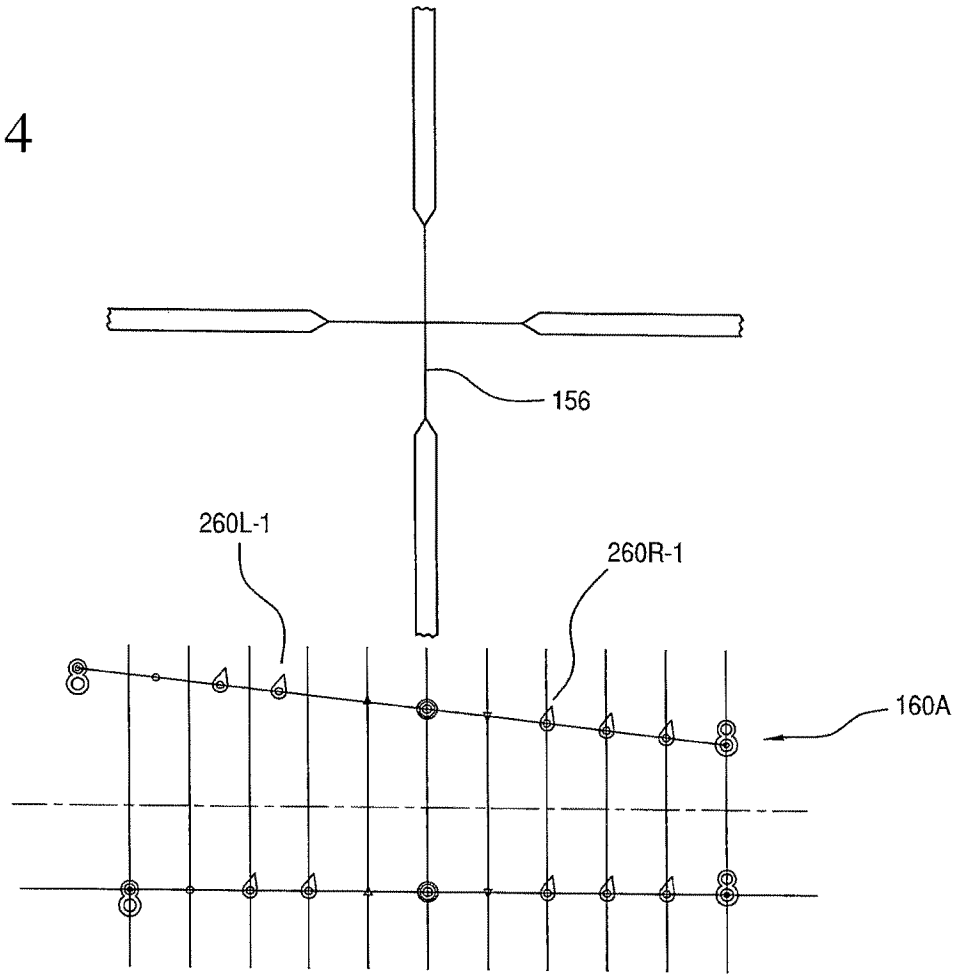
FIG. 4 further illustrates the ballistic effect compensating system and aim compensation method of FIG. 3, in accordance with the present invention.
Figure 5:
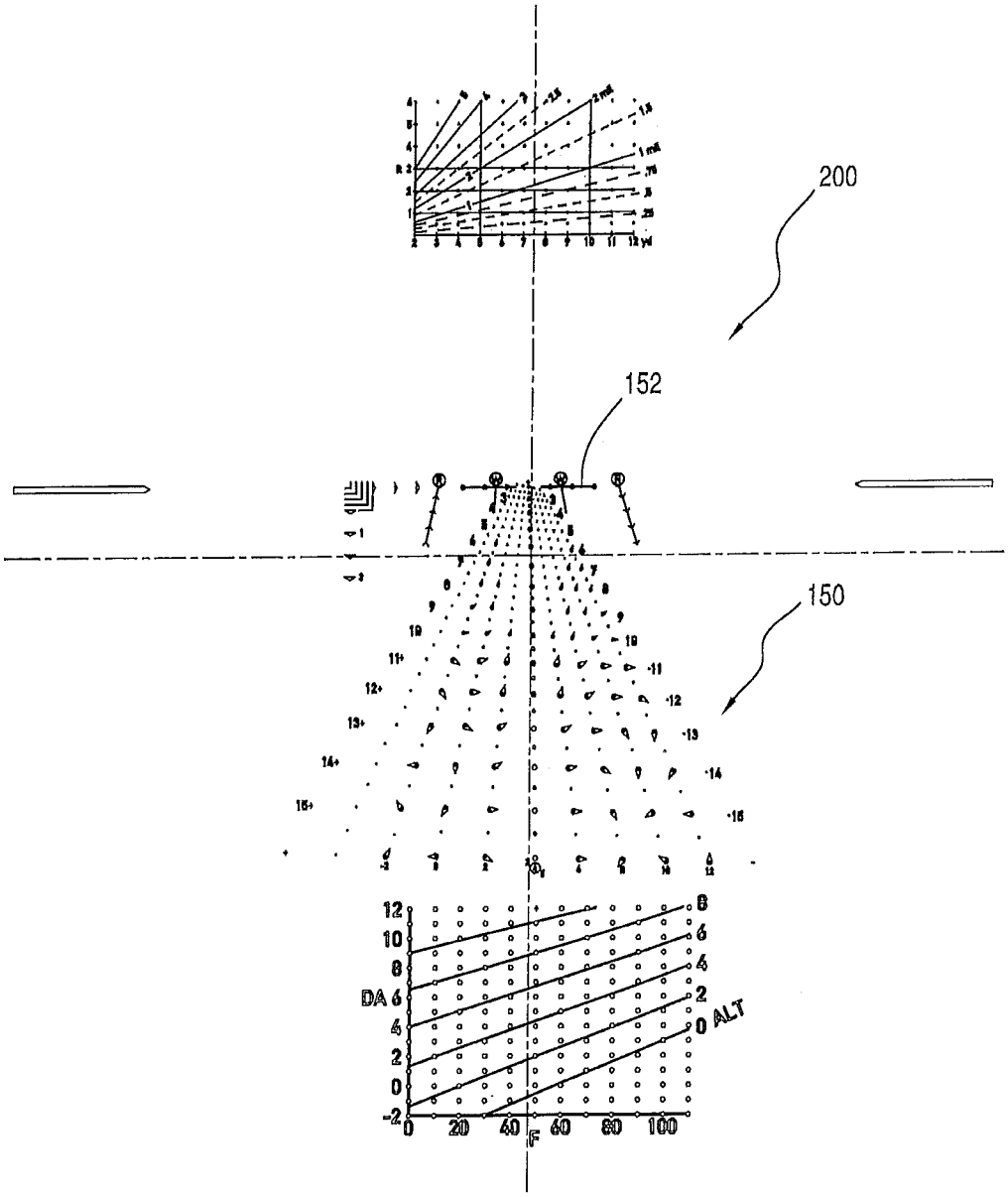
FIG. 5 illustrates a multi-nomograph embodiment of the ballistic effect compensating system and aim compensation method of FIGS. 2, 3 & 4, in accordance with the present invention.

The reticle and method of present invention as illustrated in FIGS. 2-5 comprises a new multiple nomograph system for solving ranging and ballistic problems in firearms, and is adapted particularly for use with hand held firearms (e.g., 4) having magnifying rifle scope sights. The present system as illustrated in FIG. 5 includes an aim point field 150 with a horizontal crosshair 152 comprising a linear horizontal array of aiming and measuring indicia. The ballistic effect compensating system and the reticle of FIGS. 2-5 is configured for use with any projectile weapon, and especially with a sight such as rifle scope 10 configured for developing rapid and accurate firing solutions in the field for long TOF and long trajectory shots, even in cross winds. The aiming method and reticle of the present invention are usable with or without newly developed Range Cards (described below) or pre-programmed transportable computing devices. The reticle and aiming method of the embodiment of FIGS. 2-5 is adapted to predict the effects of newly discovered combined ballistic and atmospheric effects that have an inter-relationship observed by the applicant and plotted in reticle aim point field 150, in accordance with the present invention.

The reticle and method of present invention, as illustrated in FIGS. 2-5 comprises a new multiple nomograph system 200 for solving ranging and ballistic problems in firearms, and is adapted particularly for use with hand held firearms or weapons systems (e.g., 4) having magnifying rifle scope sights (e.g., 10). The present system, as illustrated in FIGS. 2-5 includes reticle aim point field 150 which differs from prior art long range reticles in that sloped windage adjustment axes (e.g., 160A) are not horizontal, meaning that they are not simply range compensated horizontal aiming aids which are parallel to horizontal crosshair 152 and so are not perpendicular to either vertical reference crosshair 156 or substantially vertical central aiming dot line 154.

The diagrams of FIGS. 3 and 4 are provided to illustrate how the downrange (e.g., 800 yard) wind dots in aim point field 150 have been configured or plotted to aid the shooter by illustrating the inter-relationship of the external ballistic effects observed and recorded by the applicant, as part of the development work for the new reticle of the present invention. In reticle aim point field 150, the windage aim point indicia (e.g., 260L-1, as best seen in FIGS. 3 and 4) on each windage adjustment axis are not symmetrical about the vertical crosshair 156, meaning that a full value windage offset indicator (e.g. 260L-1) on the left side of vertical crosshair 156 is not spaced from vertical crosshair 156 at the same distance as the corresponding full value windage offset indicator (e.g. 260R-1) on the right side of the vertical crosshair, for a given wind velocity offset (e.g., 10 mph).

As noted above, the reticles of the prior art include a vertical crosshair intended to be seen (through the riflescope) as being precisely perpendicular to a horizontal crosshair that is parallel to the horizon when the rifle is held level to the horizon with no angular variance from vertical (or "cant"). The prior art range-compensating reticles also include a plurality of "secondary horizontal crosshairs" which are typically divided with evenly spaced indicia on both sides of the vertical crosshair. These prior art range-compensating or bullet drop compensating reticles effectively represent a prediction of where a bullet will strike a target, and that prior art prediction includes an assumption that any windage aiming offset to the left (for left wind) is going to be identical to and symmetrical with a windage aiming offset to the right (for right wind). Another assumption built into the prior art reticles pertains to the predicted effect on elevation arising from increasing windage adjustments, because the prior art reticles predict that no change in elevation (i.e., holdover) should be made, no matter how much windage adjustment is needed. This second assumption is demonstrated by the fact that the prior art reticles all have straight and parallel secondary horizontal crosshairs.

The applicant of the present invention re-examined these assumptions and empirically observed, recorded and plotted the actual ballistic performance for a series of carefully controlled shots at selected ranges, and the plotted observations have been used to develop improved reticle aim point field (e.g., 150) which has been demonstrated to be a more accurate predictor of the effects of atmospheric and environmental conditions on a bullet's flight.

Experimental Approach and Prototype Development:

As noted above, reticle system 200 and the method of the present invention are useful to predict the performance of specific ammunition fired from a specific rifle system (e.g., 4), but can be used with a range of other ammunition by using pre-defined correction criteria. The data for the reticle aim point field 150 shown in FIGS. 2 and 5 was generated using a Tubb 2000™ rifle with .284 Winchester ammunition specially prepared for long distance precision shooting. The rifle was fitted with a RH twist barrel (1:9) for the results illustrated in FIGS. 2-5.

A second set of experiments conducted with a LH twist barrel (also 1:9) confirmed that the slope of the windage axes was equal magnitude but reversed when using a LH twist barrel, meaning that the windage axes rise (from right to left) at about a 5 degree angle and the substantially vertical central aiming dot line or elevation axis (illustrating the effect of spin drift) diverges to the left of a vertical crosshair (e.g., 156).

A ballistics performance calculation (using prior art methods) for a 284 Winchester cartridge loaded with a 180 Gr Sierra Match King BTHP projectile (#1980) having a ballistic coefficient of 0.660 when fired from a rifle providing a muzzle velocity of 2850 fps generates the data shown below, in Table 1. This data assumes a sight height of 1.5 inches above the rifle's bore and is for a temperature of 80 degrees at 2K elevation (for 4K DA) when the rifle is sighted in at 500 yards.

TABLE 1

| Range | Velocity | Impact | Drop | ToF | Drift* |
|---|---|---|---|---|---|
| 0 | 2850 | −1.5 | 0 | 0 | 0 |
| 100 | 2720 | 9.21 | 2.43 | 0.11 | 0.86 |
| 200 | 2598 | 15.19 | 9.58 | 0.22 | 2.15 |
| 300 | 2479 | 16 | 21.91 | 0.34 | 4.35 |
| 400 | 2363 | 11.12 | 39.92 | 0.47 | 7.53 |
| 500 | 2252 | 0 | 64.18 | 0.6 | 11.75 |
| 600 | 2143 | −18 | 95.31 | 0.73 | 17.07 |
| 700 | 2037 | −43.58 | 134.03 | 0.88 | 23.6 |
| 800 | 1934 | −77.56 | 181.14 | 1.03 | 31.41 |
| 900 | 1835 | −120.82 | 237.54 | 1.19 | 40.59 |
| 1000 | 1740 | −174.39 | 304.25 | 1.35 | 51.25 |

*Applicant notes that the data in this table retain the prior art inferences that wind drift from a wind from the right (or 90°) is the same magnitude but opposing direction from wind drift from a wind from the left (or 270°), and left wind has no elevation effect, as compared to right wind. Thus, the "drift" and "impact" (or elevation effect) data in these tables is wrong; however, the calculated data is provided here to enable users to characterize the experimental ammunition used in generating the empirical ballistic data resulting in the reticle and system of FIGS. 2 and 5.

The reticle of the present invention preferably includes an aim point field 150 with a vertical crosshair 156 and a horizontal crosshair 152 which intersect at a right angle and also includes a plurality of windage adjustment axes (e.g., 160A) arrayed beneath horizontal crosshair 152. The windage adjustment axes (e.g., 160A) are angled downwardly at a shallow angle (e.g., five degrees, for RH twist), meaning that they are not secondary horizontal crosshairs each being perpendicular to the vertical crosshair 156. Instead, each windage axis defines an angled or sloped array of windage offset adjustment indicia (e.g., 260L-1 and 260R-1). If a windage axis line were drawn through all of the windage offset adjustment indicia corresponding to a selected range (e.g., 800 yards), that windage axis line would slope downwardly from horizontal at a small angle (e.g., five degrees), as illustrated in FIGS. 2, 3 and 4). In aim point field 150, at the 800 yard reference windage axis 160A, the right-most windage offset adjustment indicator (adjacent the "8" on the right) is one MOA below a true horizontal crosshair line and the left-most windage offset adjustment indicator (adjacent the "8" on the left) is one MOA above that true horizontal crosshair line. The effect of that slope is best seen by comparing FIGS. 3 and 4.

As noted above, the windage offset adjustment indicia on each windage adjustment axis are not symmetrical about the vertical crosshair 156 or symmetrical around the array of elevation indicia or nearly vertical central aiming dot line 154. The nearly vertical central aiming dot line 154 provides a "no wind zero" for selected ranges (e.g., 100 to more than 1500 yards, as seen in FIGS. 2 and 5), and 10 mph windage offset adjustment indicator on the left side of substantially vertical central aiming dot line 354 is not spaced from central aiming dot line 154 at the same lateral distance as the corresponding (i.e., 10 mph) windage offset adjustment indicator on the right side of the vertical crosshair. Instead, the reticle and method of the present invention define differing windage offsets for (a) wind from the left (e.g. 260L-1) and (b) wind from the right (e.g. 260R-1). Again, those windage offsets refer to elevation adjustment axis 154 which diverges laterally from vertical crosshair 156. The elevation adjustment axis or central aiming dot line 154 defines the diverging array of elevation offset adjustment indicia for selected ranges (e.g., in 100 yard increments).

The phenomena or external ballistic effects observed by the applicant are not anticipated in the prior art, but applicant's research into the scientific literature has provides some interesting insights. A scientific text entitled "Rifle Accuracy Facts" by H. R. Vaughn, and at pages 195-197, describes a correlation between gyroscopic stability and wind drift. An excerpt from another scientific text entitled "Modern Exterior Ballistics" by R. L. McCoy (with appended errata published after the author's death), at pages 267-272, describes a USAF scientific inquiry into what was called "Aerodynamic Jump" due to crosswind and experiments in aircraft. Applicant's experiments have been evaluated in light of this literature and, as a result, applicant has developed a model for two external ballistics mechanisms which appear to be at work. The first mechanism is now characterized, for purposes of the system and method of the present invention, as "Crosswind Jump" wherein the elevation-hold or adjustment direction (up or down) varies, depending on whether the shooter is compensating for left crosswind) (270° or right crosswind (90°), and the present invention's adaptation to these effects is illustrated in FIGS. 2-5.

The second mechanism (dubbed "Dissimilar Wind Drift" for purposes of the system and method of the present invention) was observed as notably distinct lateral offsets for windage, depending on whether a cross-wind was observed as left wind (270°) or right wind (90°). Referring now to FIGS. 3 and 4, the lateral offset for aimpoint indicia 260L-1 corresponds to a left wind (270°) at 10 mph and is spaced laterally farther from vertical crosshair 156 than the lateral offset for aimpoint indicia 260R-1 which corresponds to a right wind (90°) at 10 mph.

The aiming system and method of the present invention can also be used with traditional mil-dot reticles, permitting a shooter to compensate for a projectile's ballistic behavior while developing a firing solution. This would require some time consuming calculations, but a correction factor table is illustrated in FIG. 6 for use with a rifle firing a Superior Shooting System's 6XC Cartridge having a muzzle velocity of 2980 fps. FIG. 6 illustrates opposing sides of a two-sided placard 270 summarizing selected ballistics correction factors in a first and second tables for use with any projectile weapon including a rifle scope having a standard mil-dot reticle, for a specific cartridge, in accordance with the method of the present invention. This table is printable onto a portable card which the shooter can use with a rifle scope having a traditional mil-dot or MOA reticle. For a right hand twist rifle with a 6XC projectile having gyroscopic stability of 1.75-2, the data reproduced in this table illustrates the Crosswind Jump effect which is believed to be proportional to true crosswind velocity acting on the projectile (using, e.g., 6 MPH increments for ¼ MOA). The second effect (Dissimilar Wind Drift) is reflected in the correction factors shown in the four columns on the left (one would initially consult the 10 mph crosswind reference). The spin drift effect is accounted for by dialing (left wind) in the yard line columns.

The marksman or shooter may bring along a personal or transportable computer-like device (not shown) such as a personal digital assistant ("PDA") or a smart phone (e.g., an iPhone™ or a Blackberry™) and that shooter's transportable computer-like device may be readily programmed with a software application (or "app") which has been programmed with the correction factors for the shooters weapon system (e.g., using the correction factors of FIG. 6) and is thereby enabled to rapidly develop an accurate first round firing solution for selected ammunition when in the field.

Applicant's reticle system (e.g., 200 or 300) permits the shooter to express and correct the aim point selection and the firing solution in range (e.g., yards) and crosswind velocity (MPH) rather than angles (minutes of angle or MILS). Additionally the reticle aim point field (e.g., 150 or 350) provides automatic correction for spin drift, crosswind jump and dissimilar crosswind drift, none of which are provided by any other reticle. As a direct result of these unique capabilities, the shooter can develop precise long range firing solutions faster than with any other reticle. The design goal was to create a telescopic sighting system that encompasses the following attributes:

1. A system that is very quick to use and allows for shots from point blank range to well beyond 1000 yards. Time element was a huge factor in this design. Time is what wins most engagements.

2. A system that does not require an auxiliary computer or data book which takes the shooter's attention away from the target and whose failure or loss would leave the shooter stranded.

3. A system that accommodates changing atmospheric conditions, allowing its use in any reasonable geographic location.

4. A system that provides the means to actually determine target range in yards, not just measure it in MILS or MOA.

5. A system that requires fewer mathematic calculations by the user.

6. A system that uses miles per hour (mph) for windage—no MILS or MOA conversion needed (call in mph, hold in mph).

7. A system that accounts for spin drift thus giving the user a true No Wind Zero at each central aiming dot.

8. A system that accounts for crosswind jump (lift) of the bullet as it undergoes crosswind deflection.

9. A system that accounts for dissimilar wind drift (DWD) (a right-hand wind will drift a right spinning bullet further than a left-hand wind).

10. A system that allows effective elevation hold points with no external corrections under all atmospheric conditions.

11. A system that allows the user to quickly and easily adapt to changes in ammunition or rifle system velocity or ammunition ballistic ("BC") properties by using DA correction factors which permit the user to make corrections quickly in units of distance (e.g., yards or meters) to find elevation hold points with no external corrections under all atmospheric conditions.

12. A system that allows rapid application of angle cosine range correction factors denominated in distance units (e.g., yards or meters) for rapid correction of elevation hold points under all atmospheric conditions.

Meeting these goals was accomplished by employing two concepts:

1. Providing a family of reticles which accommodate bullets with a specific ballistic coefficients ("BC") and muzzle velocities under any atmospheric conditions.

2. Providing graphs in the reticle to facilitate most ranging and ballistic computations. This allows the user to make accurate compensations for varying shooting conditions without looking away from the scope. Graphs are powerful tools to display reference data and perform "no math" computations.

Figure 7:
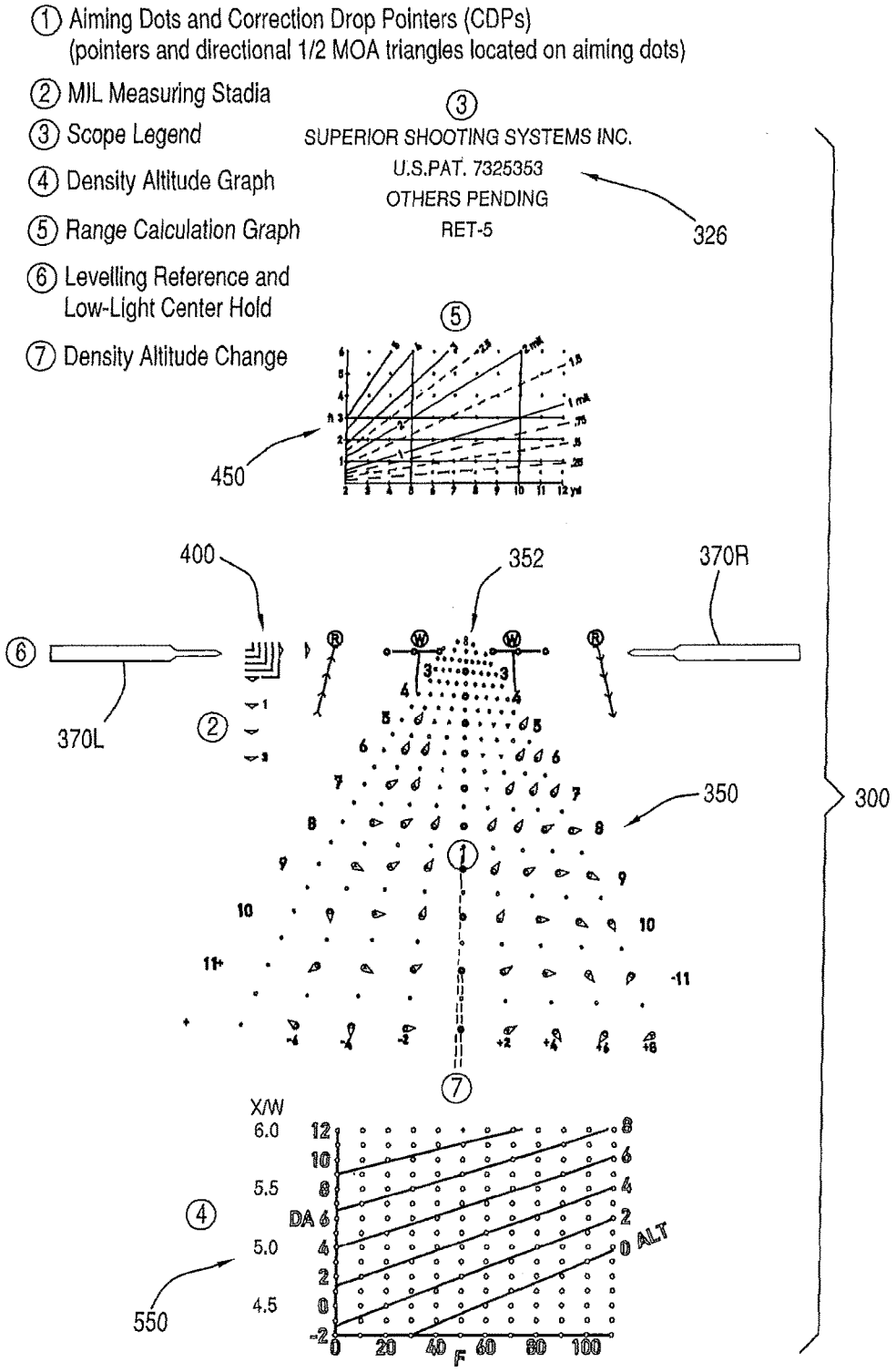
FIG. 7 illustrates a multiple nomograph ballistic effect compensating system or reticle for use with an aim compensation method for rifle sights or projectile weapon aiming systems which is readily adapted for use with any projectile weapon, and especially with a rifle scope such as that illustrated in FIGS. 1A and 1B, when firing a selected ammunition such as USGI M118LR long range ammunition, in accordance with the present invention.
Figure 8:
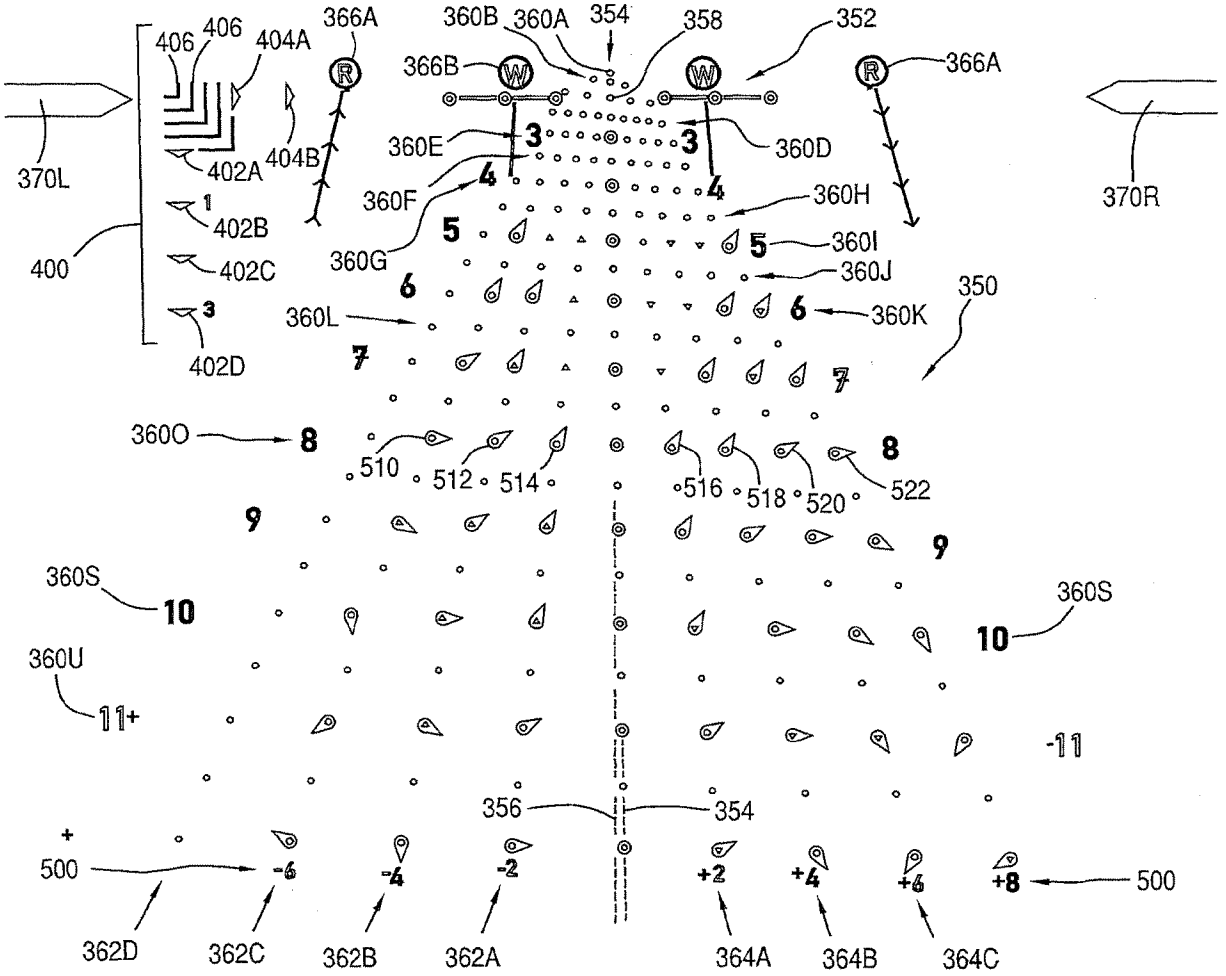
FIG. 8 illustrates the aim point field and horizontal crosshair aiming indicia array for the ballistic effect compensating system and reticle of FIG. 7, in accordance with the present invention.

The reticle and system of the present invention can also be used with the popular M118LR .308 caliber ammunition which is typically provides a muzzle velocity of 2565 FPS. Turning now to FIGS. 7 and 8, another embodiment of the reticle system and the method of the present invention 300 are useful to predict the performance of that specific ammunition fired from a specific rifle system (e.g., rifle 4, a US Army M24 or a USMC M40 variant), but can be used with a range of other ammunition by using pre-defined correction criteria, as set forth below. The data for the reticle aim point field 350 shown in FIGS. 7 and 8 was generated using a rifle was fitted with a RH twist barrel. FIG. 7 illustrates a multiple nomograph ballistic effect compensating system or reticle system 300 for use with an aim compensation method for rifle sights or projectile weapon aiming systems which is readily adapted for use with any projectile weapon, and especially with a rifle scope such as that illustrated in FIGS. 1A and 1B, when firing a selected ammunition such as USGI M118LR long range ammunition, in accordance with the present invention. FIG. 8 illustrates the aim point field 350 and horizontal crosshair aiming indicia array for the ballistic effect compensating system and reticle of FIG. 7.

FIGS. 7 and 8 illustrate a rifle scope reticle which is similar in some respects to the reticle of FIG. 1C and applicant's previous DTAC™ Reticle, as described and illustrated in applicant's own U.S. Pat. No. 7,325,353, in the prior art. FIG. 7 illustrates a reticle system having a scope legend 326 which preferably provides easily perceived indicia with information on the weapon system and ammunition as well as other data for application when practicing the method of the present invention. Reticle system 300 preferably also includes a range calculation nomograph 450 as well as an air density or density altitude calculation nomograph 550.

FIG. 8 provides a detailed view of an exemplary elevation and windage aim point field 350, with the accompanying horizontal and vertical angular measurement stadia 400 included proximate the horizontal crosshair aiming indicia array 352. The aim point field 350 is preferably incorporated in an adjustable scope reticle screen (e.g., such as 16), as the marksman uses the aim point field 350 for aiming at the target as viewed through the scope and its reticle. The aim point field 350 comprises at least the first horizontal line or crosshair 352 and a substantially vertical central aiming dot line or crosshair 354, which in the case of the field 350 is represented by a line of substantially or nearly vertical dots. A true vertical reference line 356 is shown on the aim point field 350 of FIG. 8, and may optionally comprise the vertical crosshair of the reticle aim point field 50, if so desired.

It will be noted that the substantially vertical central aiming dot line 354 is curved or skewed somewhat to the right of the true vertical reference line 356. As above, this is to compensate for gyroscopic precession or "spin drift" of a spin-stabilized bullet or projectile in its trajectory. The exemplary M24 or M40 variant rifle barrels have "right twist" inwardly projecting rifling which spirals to the right, or clockwise, from the proximal chamber to the distal muzzle of the barrel. The rifling imparts a corresponding clockwise stabilizing spin to the M118LR bullet (not shown). As the projectile or bullet travels an arcuate trajectory in its distal or down range ballistic flight between the muzzle and the target, the longitudinal axis of the bullet will deflect angularly to follow that arcuate trajectory. As noted above, the flying bullet's clockwise spin results in gyroscopic precession which generates a force that is transverse or normal (i.e., ninety degrees) to the arcuate trajectory, causing the bullet to deflect to the right. This effect is seen most clearly at relatively long ranges, where there is substantial arc to the trajectory of the bullet (e.g., as illustrated in FIG. 1E). The lateral offset or skewing of substantially vertical central aiming dot line to the right causes the user, shooter or marksman to aim or moving the alignment slightly to the left in order to position one of the aiming dots of the central line 354 on the target (assuming no windage correction). This has the effect of more nearly correcting for the rightward deflection of the bullet due to gyroscopic precession.

FIG. 8 shows how horizontal crosshair aiming mark indicia array 352 and substantially vertical central aiming dot line 354 define a single aim point 358 at their intersection. The multiple aim point field 350, as shown, is formed of a series of sloped and non-horizontal rows of windage aiming indicia which are not parallel to horizontal crosshair 352 (e.g., 360A, 360B, etc.) and which are spaced at substantially lateral intervals to provide aim points corresponding to selected crosswind velocities (e.g., 5 mph, 10 mph, 15 mph, 20 mph and 25 mph) The windage aiming indicia for each selected crosswind velocity are aligned along axes which are inwardly angled but generally vertical (spreading as they descend) to provide left side columns 362A, 362B, 362C, etc. and right side columns 364A, 364B, 364C, etc. The left side columns and right side columns comprise aiming indicia or aiming dots (which may be small circles or other shapes, in order to minimize the obscuration of the target). It will be noted that the uppermost horizontal row 360A actually comprises only a single dot each, and provides a relatively close aiming points at only one hundred yards. The aim point field 350 is configured for a rifle and scope system (e.g., 4) which has been "zeroed" (i.e., adjusted to exactly compensate for the drop of the bullet during its flight) at aim point 358, corresponding to a distance of two hundred yards, as evidenced by the primary horizontal crosshair array 352. Thus, a marksman aiming at a closer target must lower his aim point to an aim point or dot slightly above the horizontal crosshair 352 (e.g., 360A or 360B), as relatively little drop occurs to the bullet in such a relatively short flight.

In FIG. 8, most of the horizontal rows, (e.g. rows 360E, 360F, 360G, down to row 360U, are numbered to indicate the range in hundreds of yards for an accurate shot using the dots of that particular row, designating ranges of 100 yards, 150 yards (for row 360B), 200 yards, 250 yards, 300 yards (row 360E), etc. The row 360S has a mark "10" to indicate a range of one thousand yards. It will be noted that the spacing between each horizontal row (e.g., 360A, 360B . . . 360S, 360U), gradually increases as the range to the target becomes longer and longer. This is due to the slowing of the bullet and increase in vertical speed due to the acceleration of gravity during its flight. The alignment and spacing of the horizontal rows more effectively compensates for these factors, such that the vertical impact point of the bullet will be more accurate at any selected range. After row 360U, for 1100 yards, the rows are no longer numbered, as a reminder that beyond that range, it is estimated that the projectile has slowed into the transonic or subsonic speed range, where accuracy is likely to diminish in an unpredictable manner.

The nearly vertical columns 362A, 362B, 364A, 364B, etc., spread as they extend downwardly to greater and greater ranges, but not symmetrically, due to the external ballistics factors including Crosswind Jump and Dissimilar Crosswind Drift, as discussed above. These nearly vertical columns define aligned angled columns or axes of aim points configured to provide an aiming aid permitting the shooter to compensate for windage, i.e. the lateral drift of a bullet due to any crosswind component. As noted above, downrange crosswinds will have an ever greater effect upon the path of a bullet with longer ranges. Accordingly, the vertical columns spread wider, laterally, at greater ranges or distances, with the two inner columns 362A and 364A being closest to the column of central aiming dots 354 and being spaced to provide correction for a five mile per hour crosswind component, the next two adjacent columns 362B, 364B providing correction for a ten mile per hour crosswind component, etc.

In addition, a moving target must be provided with a "lead," somewhat analogous to the lateral correction required for windage. The present scope reticle includes approximate lead indicators 366B (for slower walking speed, indicated by the "W") and 366A (farther from the central aim point 358 for running targets, indicated by the "R"). These lead indicators 366A and 366B are approximate, with the exact lead depending upon the velocity component of the target normal to the bullet trajectory and the distance of the target from the shooter's position.

As above, in order to use the elevation and windage aim point field 350 of FIGS. 7 and 8, the marksman must have a reasonably close estimate of the range to the target. This is provided by means of the evenly spaced horizontal and vertical angular measurement stadia 400 disposed upon aim point field 350. The stadia 400 comprise a vertical row of stadia alignment markings 402A, 402B, etc., and a horizontal row of such markings 404A, 404B, etc. It will be noted that the horizontal markings 404A, etc. are proximate to and disposed along the horizontal reference line or crosshair 352, but this is not required; the horizontal marks could be placed at any convenient location on reticle 300. Each adjacent mark, e.g. vertical marks 402A, 402B, etc. and horizontal marks 404A, 404B, etc., are evenly spaced from one another and subtend precisely the same angle therebetween, e.g. one mil, or a tangent of 0.001. Other angular definition may be used as desired, e.g. the minute of angle or MOA system discussed in the Related Art further above. Any system for defining relatively small angles may be used, so long as the same system is used consistently for both the stadia 400 and the distance v. angular measurement nomograph 450.

Figure 10:
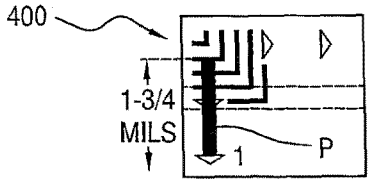
FIG. 10 illustrates an example for using the Mil Stadia range estimation graphic in the reticle of FIGS. 7 and 8 for the projectile weapon aiming system Reticle and aim compensation method of the present invention.
Figure 11:
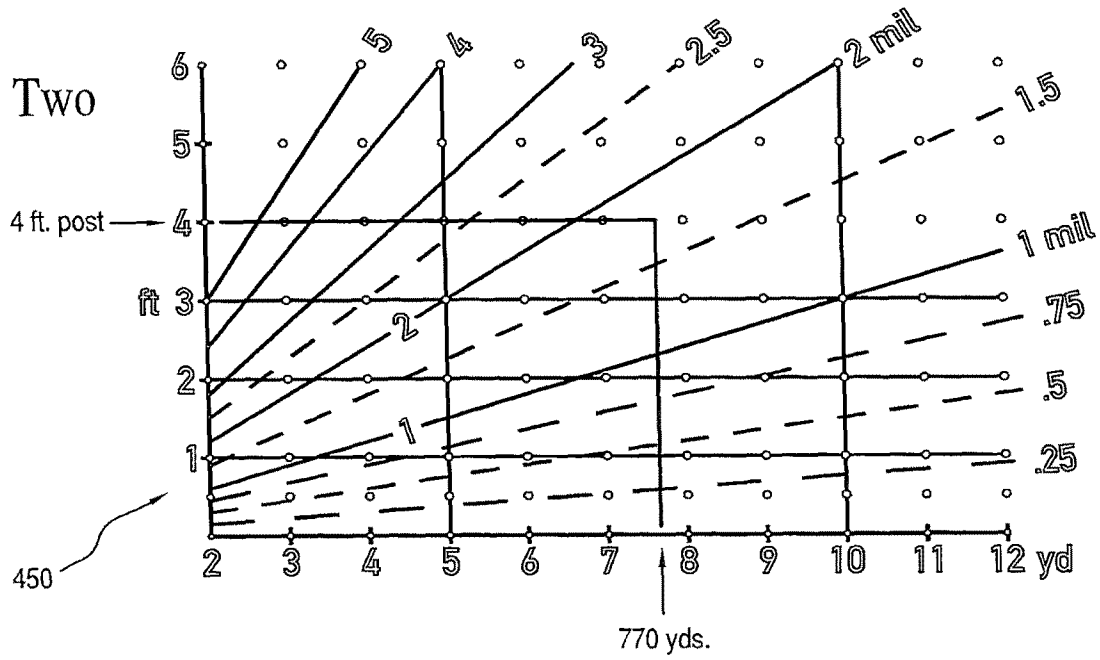
FIG. 11 illustrates the visual method calculating range using the range calculation graph to range the object shown in FIG. 10, when using the reticle of FIGS. 7 and 8, in accordance with the present invention.

Referring to FIGS. 10 and 11, the stadia system 400 is used by estimating some dimension of the target, or of an object close to the target. For example, a shooter or hunter may note that the game being sought (e.g., a Coyote) is standing near a fence line having a series of wood fence posts. The hunter knows or recognizes that the posts are about four feet tall, from prior experience. (Alternatively, he could estimate some dimension of the game, e.g. height, length, etc., but larger dimensions, e.g. the height of the fence post, are easier to gauge.) The hunter places the top of a post P (shown in broken lines along the vertical marks 402A, 402B) within the fractional mil marks 406 of the stadia 400, and adjusts the alignment of the firearm and scope vertically to place the base of the post P upon a convenient integer alignment mark, e.g. the second mark 402B. The hunter then knows that the post P subtends an angular span of one and three quarter mils, with the base of the post P resting upon the one mil mark 402B and the top of the post extending to the third of the quarter mil marks 406. The horizontal mil marks 404A, etc., along with the central aim point 358 positioned between the two horizontal marks are used similarly for determining a horizontal angle subtended by an object.

It should be noted that each of the stadia markings 402 and 404 comprises a small triangular shape, rather than a circular dot or the like, as is conventional in scope reticle markings. The polygonal stadia markings of the present system place one linear side of the polygon (preferably a relatively flat triangle) normal to the axis of the stadia markings, e.g. the horizontal crosshair 352. This provides a precise, specific alignment line, i.e. the base of the triangular mark, for alignment with the right end or the bottom of the target or adjacent object, depending upon whether the length or the height of the object is being ranged. Conventional round circles or dots are subject to different procedures by different shooters, with some shooters aligning the base or end of the object with the center of the dot, as they would with the sighting field, and others aligning the edge of the object with one side of the dot. It will be apparent that this can lead to errors in subtended angle estimation, and therefore in estimating the distance to the target.

Referring back to FIG. 8, the bottom of aim point field 350 includes a density correction graphic indicia array 500 comprising a plurality of density altitude adjustment change factors (e.g., "−2" for column 362A, "−4" for column 362B, "−6" for column 3620, "+2" for column 364A, and "+4" for column 364B, and these are for use with the tear-drop shaped Correction Drop Pointers (e.g., 510, 512, 514, 516, 518, 520, 522, as seen aligned along the 800 Yard array of windage aiming points 360-0). Each of the density correction drop pointers (e.g., 510, 512, etc) provides a clock-hour-hand like pointer which corresponds to an imaginary clock face on the aim point field 350 to designate whole numbers of MOA correction values. Aim point field 350 also includes aim points having correction pointers with an interior triangle graphic inside the correction drop pointer (e.g., 518) indicating the direction for an added ½ or 0.5 MOA correction on the hold (e.g., when pointing down, dial down or hold low by ½ MOA).

Figure 9A:
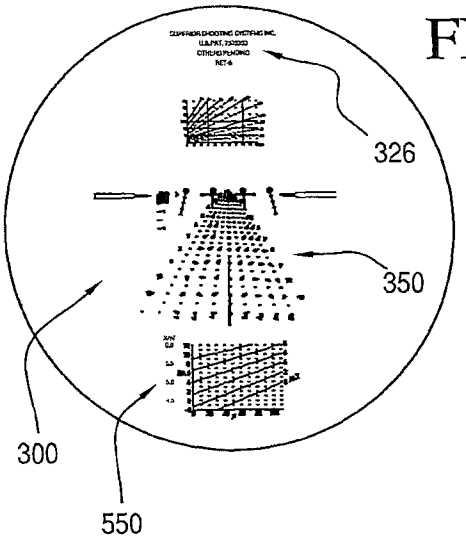
FIG. 9A illustrates the position and orientation and graphic details of the Density Altitude calculation nomograph included as part of reticle system of FIG. 7, when viewed at the lowest magnification setting, in accordance with the present invention.
Figure 9B:
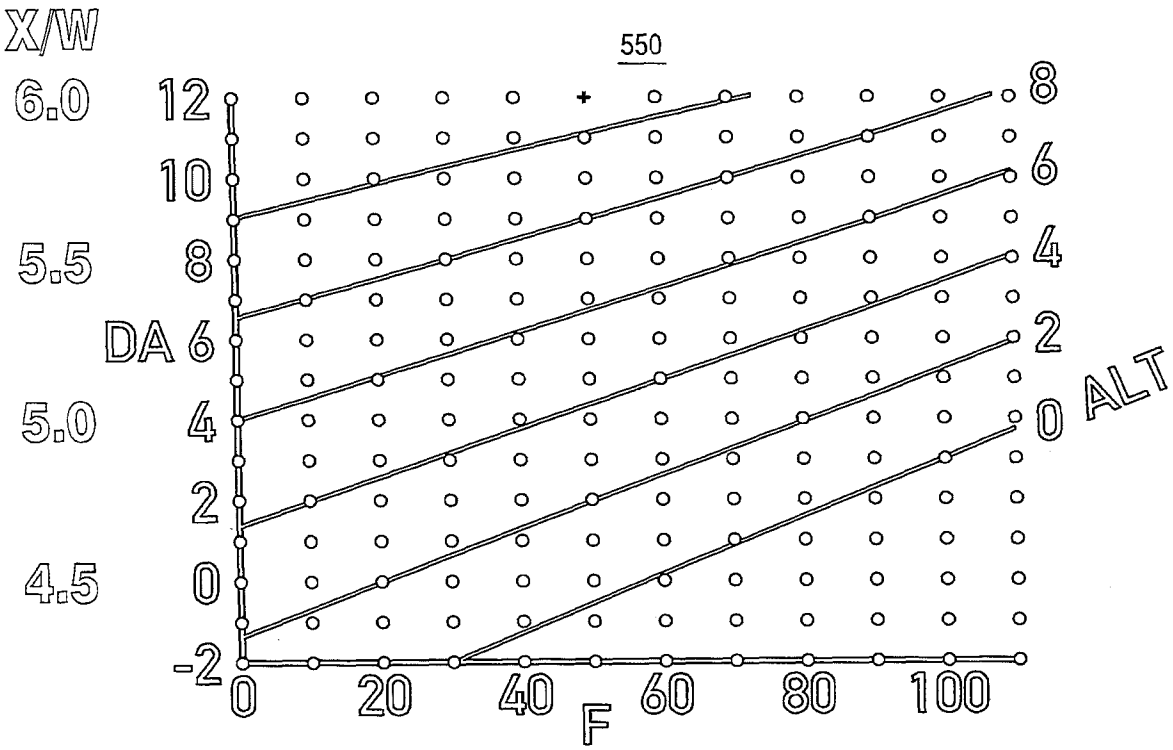
FIG. 9B illustrates orientation and graphic details of the Density Altitude calculation nomograph of FIGS. 7, and 9A, in accordance with the present invention.

Reticle 300 of FIG. 8 represents a much improved aid to precision shooting over long ranges, such as the ranges depicted in FIG. 1E, where air density plays an increasingly significant role in accurate aiming. Air density affects drag on the projectile, and lower altitudes have denser atmosphere. At a given altitude or elevation above sea level, the atmosphere's density decreases with increasing temperature. FIGS. 9A and 9B illustrate the position, orientation and graphic details of the Density Altitude calculation nomograph 550 included as part of reticle system 300. The crosswind (XW) values to the left of the DA graph indicate the wind hold (dot or triangle) value at the corresponding DA for the shooter's location. For example, X/W value "5" is 5 mph at 4000 DA or 4K DA. X/W value "5.5" is 5.5 mph at 8000 DA or 8K DA (adding ½ mph to the wind hold). X/W value "4.5" is 4.5 mph at 2000 DA or 2K DA (subtracting ½ mph from the wind hold). The mph rows of correction drop pointers in aim point field 350 are used to find corresponding corrections for varying rifle and ammunition velocities. Velocity variations for selected types of ammunition can be accounted for by selecting an appropriate DA number.

DA represents "Density Altitude" and variations in ammunition velocity can be integrated into the aim point correction method by selecting a lower or higher DA correction number, and this part of the applicant's new method is referred to as "DA Adaptability". This means that family of reticles is readily made available for a number of different bullets. This particular example is for the USGI M118LR ammunition, which is a 0.308, 175 gr. Sierra™ Match King™ bullet, modeled for use with a rifle having scope 2.5 inches over bore centerline and a 100 yard zero. It has been discovered that the bullet's flight path will match the reticle at the following combinations of muzzle velocities and air densities:

2 k DA=2625 FPS and 43.8 MOA at 1100 yards
3 k DA=2600 FPS and 43.8 MOA at 1100 yards
4 k DA=2565 FPS and 43.6 MOA at 1100 yards
5 k DA=2550 FPS and 43.7 MOA at 1100 yards
6 k DA=2525 FPS and 43.7 MOA at 1100 yards 1100 yard come-ups were used since this bullet is still above the transonic region. Thus, the reticle's density correction graphic indicia array 500 can be used with Density Altitude Graph 550 to provide the user with a convenient method to adjust or correct the selected aim point for a given firing solution when firing using different types of ammunition or in varying atmospheric conditions with varying air densities.

Figures 12, 13:
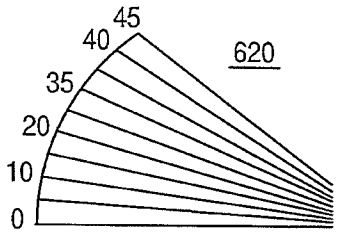
FIGS. 12 and 13 illustrates two sides of a transportable a placard having an angle firing graphic estimator for cosine range computation and summarizing selected ballistics correction factors in a table for use with any projectile weapon including a rifle scope having a standard mil-dot reticle, for a specific cartridge, in accordance with the method of the present invention.

In accordance with the method and system of the present invention, each user is provided with a placard or card 600 for each scope which defines the bullet path values (come-ups) at 100 yard intervals. When the user sets up their rifle system, they chronograph their rifle and pick the Density Altitude which matches rifle velocity. Handloaders have the option of loading to that velocity to match the main reticle value. These conditions which result in a bullet path that matches the reticle is referred to throughout this as the "nominal" or "main" conditions. The scope legend, viewed by zooming back to the minimum magnification, shows the model and revision number of the reticle from which can be determined the main conditions which match the reticle. FIGS. 12 and 13 illustrates two sides of a transportable placard 600 having an angle firing graphic estimator 620 for cosine range computation and summarizing selected ballistics correction factors in a table for use with any projectile weapon including a rifle scope having a standard mil-dot reticle, for a specific cartridge, in accordance with the method of the present invention. FIGS. 14A, 14B, 14C, 15A, 15B and 16 illustrate transportable placards summarizing ballistics information about a selected projectile (e.g., the M118LR) for use in finding Density Altitude ("DA") adaptability factors as part of the aim compensation method of the present invention.

Experienced long range marksmen and persons having skill in the art of external ballistics as applied to long range precision shooting will recognize that the present invention makes available a novel ballistic effect compensating reticle system (e.g., 200 or 300) for rifle sights or projectile weapon aiming systems adapted to provide a field expedient firing solution for a selected projectile, comprising: (a) a multiple point elevation and windage aim point field (e.g., 150 or 350) including a primary aiming mark (e.g., 158 or 358) indicating a primary aiming point adapted to be sighted-in at a first selected range (e.g., 200 yards); (b) the aim point field including a nearly vertical array of secondary aiming marks (e.g., 154 or 354) spaced progressively increasing incremental distances below the primary aiming point and indicating corresponding secondary aiming points along a curving, nearly vertical axis intersecting the primary aiming mark, the secondary aiming points positioned to compensate for ballistic drop at preselected regular incremental ranges beyond the first selected range for the selected projectile having pre-defined ballistic characteristics; and (c) the aim point field also includes a first array of windage aiming marks (e.g., 260L-1 and 260 R-1) spaced apart along a secondary non-horizontal axis 160A intersecting a first selected secondary aiming point (e.g., corresponding to a selected range); (d) wherein the first array of windage aiming marks includes a first windage aiming mark spaced apart to the left of the vertical axis (260L-1) at a first windage offset distance from the vertical axis selected to compensate for right-to-left crosswind of a preselected first incremental velocity at the range of said first selected secondary aiming point, and a second windage aiming mark (260R-1) spaced apart to the right of the vertical axis at a second windage offset distance from the vertical axis selected to compensate for left-to-right crosswind of said preselected first incremental velocity at said range of said first selected secondary aiming point; (e) wherein said first array of windage aiming marks define a sloped row of windage aiming points (e.g., as best seen in FIG. 4) having a slope which is a function of the direction and velocity of said projectile's stabilizing spin or a rifle barrel's rifling twist rate and direction, thus compensating for said projectile's crosswind jump; and (f) the reticle thereby facilitating aiming compensation for ballistics and windage for two crosswind directions at a first preselected incremental crosswind velocities, at a first preselected incremental range corresponding to said first selected secondary aiming point.

In the illustrated embodiments, the ballistic effect compensating reticle (e.g., 200 or 300) has several arrays of windage aiming marks which define a sloped row of windage aiming points having a negative slope which is a function of the right-hand spin direction for the projectile's stabilizing spin or a rifle barrel's right-hand twist rifling, thus compensating for the projectile's crosswind jump and providing a more accurate "no wind zero" for any range for which the projectile remains supersonic.

The ballistic effect compensating reticle (e.g., 200 or 300) has each secondary aiming point intersected by a secondary array of windage aiming marks (e.g., 360E) defining a sloped row of windage aiming points having a slope which is a function of the direction and velocity of said projectile's stabilizing spin or a rifle barrel's rifling twist rate and direction, and that sloped row of windage aiming points are spaced for facilitating aiming compensation for ballistics and windage for two or more preselected incremental crosswind velocities (e.g., 5, 10, 15, 20 and 25 mph), at the range of the corresponding secondary aiming point (e.g., 300 yards for windage aiming mark array 360E). In the illustrated embodiment, each sloped row of windage aiming points includes windage aiming marks positioned to compensate for leftward and rightward crosswinds of 10 miles per hour and 20 miles per hour at the range of the secondary aiming point corresponding to said sloped row of windage aiming points, and at least one of the sloped row of windage aiming points is bounded by laterally spaced distance indicators. Preferably, at least one of the windage aiming points is proximate an air density or projectile ballistic characteristic adjustment indicator such as those arrayed in density correction indicia array 500, and the air density or projectile ballistic characteristic adjustment indicator is preferably a Density Altitude (DA) correction indicator.

Generally, the ballistic effect compensating reticle (e.g., 200 or 300) defines a nearly vertical array of secondary aiming marks (e.g., 154 or 354) indicating corresponding secondary aiming points along a curving, nearly vertical axis are curved in a direction that is a function of the direction of said projectile's stabilizing spin or a rifle barrel's rifling direction, thus compensating for spin drift. The primary aiming mark (e.g., 358) is formed by an intersection of a primary horizontal sight line (e.g., 352) and the nearly vertical array of secondary aiming marks indicating corresponding secondary aiming points along the curving, nearly vertical axis. The primary horizontal sight line includes preferably a bold, widened portion (370L and 370R) located radially outward from the primary aiming point, the widened portion having an innermost pointed end located proximal of the primary aiming point. The ballistic effect compensating reticle preferably also has a set of windage aiming marks spaced apart along the primary horizontal sight line 352 to the left and right of the primary aiming point to compensate for target speeds corresponding to selected leftward and rightward velocities, at the first selected range.

Ballistic effect compensating reticle aim point field (e.g., 150 or 350) preferably also includes a second array of windage aiming marks spaced apart along a second non-horizontal axis intersecting a second selected secondary aiming point; and the second array of windage aiming marks includes a third windage aiming mark spaced apart to the left of the vertical axis at a third windage offset distance from the vertical axis selected to compensate for right-to-left crosswind of the preselected first incremental velocity (e.g., 10 mph) at the range of said second selected secondary aiming point (e.g., 800 yards), and a fourth windage aiming mark spaced apart to the right of the vertical axis at a fourth windage offset distance from the vertical axis selected to compensate for left-to-right crosswind of the same preselected first incremental velocity at the same range, and the second array of windage aiming marks define another sloped row of windage aiming points having a slope which is also a function of the direction and velocity of said projectile's stabilizing spin or a rifle barrel's rifling twist rate and direction, thus compensating for the projectile's crosswind jump. In addition, the ballistic effect compensating reticle's aim point field also includes a third array of windage aiming marks spaced apart along a third non-horizontal axis intersecting a third selected secondary aiming point, where the third array of windage aiming marks includes a fifth windage aiming mark spaced apart to the left of the vertical axis at a fifth windage offset distance from the vertical axis selected to compensate for right-to-left crosswind of the preselected first incremental velocity at the range of said third selected secondary aiming point, and a sixth windage aiming mark spaced apart to the right of the vertical axis at a sixth windage offset distance from the vertical axis selected to compensate for left-to-right crosswind of said preselected first incremental velocity at said range of said third selected secondary aiming point; herein said second array of windage aiming marks define another sloped row of windage aiming points having a slope which is also a function of the direction and velocity of said projectile's stabilizing spin or a rifle barrel's rifling twist rate and direction, thus compensating for crosswind jump.

The ballistic effect compensating reticle (e.g., 200 or 300) may also have the aim point field's first array of windage aiming marks spaced apart along the second non-horizontal axis to include a third windage aiming mark spaced apart to the left of the vertical axis at a third windage offset distance from the first windage aiming mark selected to compensate for right-to-left crosswind of twice the preselected first incremental velocity at the range of said second selected secondary aiming point, and have a fourth windage aiming mark spaced apart to the right of the vertical axis at a fourth windage offset distance from the second windage aiming mark selected to compensate for left-to-right crosswind of twice said preselected first incremental velocity at said range of said selected secondary aiming point. Thus the third windage offset distance is greater than or lesser than the fourth windage offset distance, where the windage offset distances are a function of or are determined by the direction and velocity of the projectile's stabilizing spin or a rifle barrel's rifling twist rate and direction, thus compensating for the projectile's Dissimilar Wind Drift. The ballistic effect compensating reticle has the third windage offset distance configured to be greater than the fourth windage offset distance, and the windage offset distances are a function of or are determined by the projectile's right hand stabilizing spin or a rifle barrel's rifling right-twist direction, thus compensating for said projectile's Dissimilar Wind Drift.

Broadly speaking, the ballistic effect compensating reticle system (e.g., 200 or 300) has an aim point field configured to compensate for the selected projectile's ballistic behavior while developing a field expedient firing solution expressed two-dimensional terms of:

(a) range or distance, used to orient a field expedient aim point vertically among the secondary aiming marks in said vertical array, and (b) windage or relative velocity, used to orient said aim point laterally among a selected array of windage hold points.

The ballistic effect aim compensation method for use when firing a selected projectile from a selected rifle or projectile weapon (e.g., 4) and developing a field expedient firing solution, comprises: (a) providing a ballistic effect compensating reticle system (e.g., 200 or 300) comprising a multiple point elevation and windage aim point field (e.g., 150 or 350) including a primary aiming mark intersecting a nearly vertical array of secondary aiming marks spaced along a curving, nearly vertical axis, the secondary aiming points positioned to compensate for ballistic drop at preselected regular incremental ranges beyond the first selected range for the selected projectile having pre-defined ballistic characteristics; and said aim point field also including a first array of windage aiming marks spaced apart along a secondary non-horizontal axis intersecting a first selected secondary aiming point; wherein said first array of windage aiming marks define a sloped row of windage aiming points having a slope which is a function of the direction and velocity of said projectile's stabilizing spin or a rifle barrel's rifling twist rate and direction, thus compensating for said projectile's crosswind jump; (b) based on at least the selected projectile, identifying said projectile's associated nominal Air Density ballistic characteristics; (c) determining a range to a target, based on the range to the target and the nominal air density ballistic characteristics of the selected projectile, determining a yardage equivalent aiming adjustment for the projectile weapon; (d) determining a windage hold point, based on any crosswind sensed or perceived, and (e) aiming the rifle or projectile weapon using said yardage equivalent aiming adjustment for elevation hold-off and said windage hold point.

The ballistic effect aim compensation method of the present invention includes providing ballistic compensation information as a function of and indexed according to an atmospheric condition such as density altitude for presentation to a user of a firearm, and then associating said ballistic compensation information with a firearm scope reticle feature to enable a user to compensate for existing density altitude levels to select one or more aiming points displayed on the firearm scope reticle (e.g., 200 or 300). The ballistic compensation information is preferably encoded into markings (e.g., indicia array 500) disposed on the reticle of the scope via an encoding scheme, and the ballistic compensation information is preferably graphed, or tabulated into markings disposed on the reticle of the scope. In the illustrated embodiments, the ballistic compensation information comprises density altitude determination data and a ballistic correction chart indexed by density altitude.

The ballistic effect aim compensation system to adjust the point of aim of a projectile firing weapon or instrument firing a selected projectile under varying atmospheric and wind conditions (e.g. with a reticle such as 200 or 300) includes a plurality of aiming points disposed upon said reticle, said plurality of aiming points positioned for proper aim at various predetermined range-distances and wind conditions and including at least a first array of windage aiming marks spaced apart along a non-horizontal axis (e.g., array 360-0 for 800 yards), wherein said first array of windage aiming marks define a sloped row of windage aiming points having a slope which is a function of the direction and velocity of the selected projectile's stabilizing spin or a rifle barrel's rifling twist rate and direction, thus compensating for said selected projectile's crosswind jump; and where all of said predetermined range-distances and wind conditions are based upon a baseline atmospheric condition. The system preferably includes a means for determining existing density altitude characteristics (such as DA graph 550) either disposed on the reticle or external to the reticle; and also includes ballistic compensation information indexed by density altitude criteria configured to be provided to a user or marksman such that the user can compensate or adjust an aim point to account for an atmospheric difference between the baseline atmospheric condition and an actual atmospheric condition; wherein the ballistic compensation information is based on and indexed according to density altitude to characterize the actual atmospheric condition.

Preferably, the ballistic compensation information is encoded into the plurality of aiming points disposed upon the reticle, as in FIGS. 7 and 8. Preferably, the reticle also includes ballistic compensation indicia disposed upon the reticle and ballistic compensation information is encoded into the indicia (as shown in FIG. 8, or alternatively, the ballistic compensation information can be positioned external to the reticle, on transportable placards such as placard 600 of FIG. 13. The ballistic compensation information may also be encoded into the plurality of aiming points disposed upon said reticle (e.g., such as Correction Drop Pointers 510, 512), where the encoding is done via display of an density correction encoding scheme that comprises an array of range-specific density correction pointers being displayed on the reticle at selected ranges.

Having described preferred embodiments of a new and improved reticle and method, it is believed that other modifications, variations and changes will be suggested to those skilled in the art in view of the teachings set forth herein. It is therefore to be understood that all such variations, modifications and changes are believed to fall within the scope of the present invention as set forth in the following claims.

I claim:

1. A ballistic effect aim compensation system to adjust the point of aim of a projectile firing weapon or instrument firing a selected projectile under varying atmospheric and wind conditions, the system comprising:

a reticle disposed within a firearm scope;

a plurality of aiming points disposed upon said reticle, said plurality of aiming points positioned for proper aim at various predetermined range-distances and wind conditions and including at least a first array of windage aiming marks spaced apart along a non-horizontal axis, wherein said first array of windage aiming marks define a sloped row of windage aiming points having a slope which is a function of the direction and velocity of the selected projectile's stabilizing spin or a rifle barrel's rifling twist rate and direction, thus compensating for said selected projectile's crosswind jump;

wherein all of said predetermined range-distances and wind conditions are based upon a baseline atmospheric condition;

a means for determining existing density altitude characteristics, said means for determining existing density altitude characteristics being disposed on said reticle or external to said reticle; and ballistic compensation information indexed by density altitude criteria configured to be provided to a user or marksman such that the user can compensate or adjust an aim point to account for an atmospheric difference between the baseline atmospheric condition and an actual atmospheric condition;

wherein ballistic compensation information is based on and indexed according to density altitude to characterize the actual atmospheric condition.

2. The ballistic effect aim compensation system of claim 1, wherein the ballistic compensation information is encoded into the plurality of aiming points disposed upon said reticle.

3. The ballistic effect aim compensation system of claim 2, further comprising indicia being disposed upon the reticle and wherein ballistic compensation information is encoded into the indicia.

4. The ballistic effect aim compensation system of claim 1, wherein the ballistic compensation information is positioned external to the reticle.

5. The ballistic effect aim compensation system of claim 2, wherein the ballistic compensation information is encoded into the plurality of aiming points disposed upon said reticle, wherein the encoding is done via display of an density correction encoding scheme that comprises an array of range-specific density correction pointers being displayed on said reticle at selected ranges.

6. The ballistic effect aim compensation system of claim 1, wherein said baseline atmospheric condition is Air Density expressed in units of kDA.

7. The ballistic effect aim compensation system of claim 1, wherein said baseline atmospheric condition is Air Density expressed in units of DU.

* * * * *